US012442056B2

(12) United States Patent
Yang et al.

(10) Patent No.: US 12,442,056 B2
(45) Date of Patent: Oct. 14, 2025

(54) HIGH-STRENGTH GALVANIZED STEEL SHEET AND MEMBER, AND METHOD FOR MANUFACTURING SAME

(71) Applicant: JFE Steel Corporation, Tokyo (JP)

(72) Inventors: Lingling Yang, Tokyo (JP); Yuki Toji, Tokyo (JP); Tomomi Kanazawa, Tokyo (JP); Shunsuke Yamamoto, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 97 days.

(21) Appl. No.: 18/568,407

(22) PCT Filed: Mar. 18, 2022

(86) PCT No.: PCT/JP2022/012541
§ 371 (c)(1),
(2) Date: Dec. 8, 2023

(87) PCT Pub. No.: WO2022/264585
PCT Pub. Date: Dec. 22, 2022

(65) Prior Publication Data

US 2024/0271243 A1 Aug. 15, 2024

(30) Foreign Application Priority Data

Jun. 15, 2021 (JP) ..... 2021-099666

(51) Int. Cl.
*C21D 9/46* (2006.01)
*C21D 1/18* (2006.01)
(Continued)

(52) U.S. Cl.
CPC ..... *C21D 9/46* (2013.01); *C21D 1/18* (2013.01); *C21D 6/001* (2013.01); *C21D 6/002* (2013.01);
(Continued)

(58) Field of Classification Search
CPC . C21D 9/46; C21D 1/18; C21D 6/001; C21D 6/002; C21D 6/005; C21D 6/007;
(Continued)

(56) References Cited

U.S. PATENT DOCUMENTS

2019/0338388 A1 11/2019 Pipard et al.
2020/0181729 A1 6/2020 Pipard et al.
(Continued)

FOREIGN PATENT DOCUMENTS

JP 2020503443 A 1/2020
JP 2020524743 A 8/2020
(Continued)

OTHER PUBLICATIONS

International Search Report and Written Opinion for International Application No. PCT/JP2022/012541, dated Jun. 7, 2022, 6 pages.
(Continued)

*Primary Examiner* — Katherine A Christy
(74) *Attorney, Agent, or Firm* — Buchanan Ingersoll & Rooney PC

(57) ABSTRACT

A high strength galvanized steel sheet is disclosed having a tensile strength of 1,320 MPa or more. A chemical composition of a steel sheet contains, by mass, C: 0.150 to 0.450%, Si: 0.80 to 3.00%, Mn: 2.00 to 4.00%, P: not more than 0.100%, S: not more than 0.0200%, Al: not more than 0.100%, O: not more than 0.0100%, and N: not more than 0.0100%, with a balance of Fe and inevitable impurities. An amount of diffusible hydrogen in steel is not more than 0.60 mass ppm. A total of tempered martensite and bainite is 60 to 95%, retained austenite is 5 to 30%, and retained austenite having an aspect ratio of 5.5 or higher with respect to an entire retained austenite is not more than 50%, and fresh martensite having a diameter of 2.0 μm or less is not more than 20%.

20 Claims, 2 Drawing Sheets

(51) Int. Cl.

| | |
|---|---|
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| ***C22C 38/34*** | (2006.01) |
| ***C22C 38/38*** | (2006.01) |
| ***C22C 38/60*** | (2006.01) |
| ***C23C 2/02*** | (2006.01) |
| ***C23C 2/06*** | (2006.01) |
| ***C23C 2/28*** | (2006.01) |
| ***C23C 2/40*** | (2006.01) |

(52) U.S. Cl.

CPC ..... *C21D 6/005* (2013.01); *C21D 6/007* (2013.01); *C21D 6/008* (2013.01); *C21D 8/0205* (2013.01); *C21D 8/0226* (2013.01); *C21D 8/0236* (2013.01); *C21D 8/0257* (2013.01); *C21D 8/0263* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/34* (2013.01); *C22C 38/38* (2013.01); *C22C 38/60* (2013.01); *C23C 2/022* (2022.08); *C23C 2/06* (2013.01); *C23C 2/28* (2013.01); *C23C 2/40* (2013.01); *C21D 2211/001* (2013.01); *C21D 2211/002* (2013.01); *C21D 2211/008* (2013.01); *C22C 2202/02* (2013.01)

(58) Field of Classification Search

CPC .... C21D 6/008; C21D 6/0205; C21D 6/0226; C21D 6/0236; C21D 6/0257; C21D 6/0263; C21D 2211/001; C21D 2211/002; C21D 2211/008; C23C 2/022; C23C 2/06; C23C 2/28; C23C 2/40; C22C 38/001; C22C 38/002; C22C 38/005; C22C 38/008; C22C 38/02; C22C 38/04; C22C 38/06; C22C 38/08; C22C 38/10; C22C 38/12; C22C 38/14; C22C 38/16; C22C 38/34; C22C 38/38; C22C 38/60; C22C 2202/02

USPC ..... 428/639

See application file for complete search history.

(56) References Cited

U.S. PATENT DOCUMENTS

| | | | |
|---|---|---|---|
| 2020/0232083 | A1 | 7/2020 | Morishita et al. |
| 2021/0010115 | A1 | 1/2021 | Yoshitomi et al. |
| 2021/0324504 | A1 | 10/2021 | Hirashima et al. |
| 2022/0251676 | A1 | 8/2022 | Minami et al. |
| 2022/0364196 | A1 | 11/2022 | Endoh et al. |

FOREIGN PATENT DOCUMENTS

| | | | |
|---|---|---|---|
| WO | 2019026106 | A1 | 2/2019 |
| WO | 2019189842 | A1 | 10/2019 |
| WO | 2020017609 | A1 | 1/2020 |
| WO | 2020079926 | A1 | 4/2020 |
| WO | 2021019947 | A1 | 2/2021 |
| WO | 2021/079754 | A1 | 4/2021 |

OTHER PUBLICATIONS

Extended European Search Report issued Feb. 14, 2025, by the European Patent Office in corresponding European Patent Application No. 22824581.7-1103. (10 pages).

HIGH-STRENGTH GALVANIZED STEEL SHEET AND MEMBER, AND METHOD FOR MANUFACTURING SAME

CROSS REFERENCE TO RELATED APPLICATIONS

This is the U.S. National Phase application of PCT/JP2022/012541, filed Mar. 18, 2022, which claims priority to Japanese Patent Application No. 2021-099666 filed Jun. 15, 2021, the disclosures of these applications being incorporated herein by reference in their entireties for all purposes.

FIELD OF THE INVENTION

The present invention relates to a high strength galvanized steel sheet having a tensile strength (TS) of not less than 1,320 MPa and a method for producing the same.

The present invention also relates to a member that is formed using a high strength galvanized steel sheet and a method for producing the same.

BACKGROUND OF THE INVENTION

In recent years, in the automobile industry, for example, from a viewpoint of the conservation of the global environment, there has been a demand for improved fuel efficiency of automobiles for the purpose of reducing carbon dioxide ($CO_2$) emission.

Reduction in vehicle body weight is effective in improving fuel efficiency of automobiles, and in an attempt thereof, it is necessary to reduce vehicle body weight while maintaining strength of a vehicle body.

Patent Literature 1, for example, discloses a high strength steel sheet having good formability.

PATENT LITERATURE

Patent Literature 1: WO 2020/017609

SUMMARY OF THE INVENTION

A high strength steel sheet having a tensile strength of not less than 1,320 MPa normally contains a large amount of alloy elements necessary for achieving the high strength. At a spot welding portion obtained by spot welding such high strength steel sheets, in some cases, toughness of a heat-affected part around a nugget (weld solidified part) is insufficient, and when the portion repeatedly receives stress, strength (fatigue strength) thereof is insufficient.

If fatigue strength of the spot welding portion can be prevented from decreasing, collision strength of an entire automobile can be sufficiently maintained.

Aspects of the present invention have been made in view of the foregoing and has an object of providing a high strength galvanized steel sheet having a tensile strength of not less than 1,320 MPa and also having excellent formability and fatigue strength of a spot welding portion.

The present inventors found, through an earnest study, that employing the configuration described below enables the achievement of the above-mentioned object, and aspects of the invention have been completed.

Specifically, aspects of the present invention provide the following [1] to [15].

[1] A high strength galvanized steel sheet comprising a steel sheet and a galvanizing layer and having a tensile strength of not less than 1,320 MPa, wherein the steel sheet has a chemical composition containing, by mass, C: 0.150 to 0.450%, Si: 0.80 to 3.00%, Mn: 2.00 to 4.00%, P: not more than 0.100%, S: not more than 0.0200%, Al: not more than 0.100%, O: not more than 0.0100%, and N: not more than 0.0100%, with a balance of Fe and inevitable impurities, and a microstructure, an amount of diffusible hydrogen in steel is not more than 0.60 mass ppm, and in the microstructure, a total area fraction of tempered martensite and bainite is 60 to 95%, an area fraction of retained austenite is 5 to 30%, an area fraction of the retained austenite having an aspect ratio of 5.5 or higher with respect to a whole of the retained austenite is not more than 50%, and an area fraction of fresh martensite having a diameter of 2.0 μm or less is not more than 20%.

[2] The high strength galvanized steel sheet according to [1], wherein the chemical composition further contains at least one element selected from the group consisting of, by mass, B: not more than 0.0050%, Ti: not more than 0.200%, Nb: not more than 0.200%, V: not more than 0.500%, W: not more than 0.500%, Mo: not more than 1.000%, Cr: not more than 1.000%, Sb: not more than 0.200%, Sn: not more than 0.200%, Zr: not more than 0.1000%, Cu: not more than 1.000%, Ni: not more than 1.000%, Ca: not more than 0.0050%, Mg: not more than 0.0050%, REM: not more than 0.0050%, Co: not more than 0.30%, Ta: not more than 0.10%, As: not more than 0.100%, Pb: not more than 0.100%, Zn: not more than 0.100%, Bi: not more than 0.100%, and Hf: not more than 0.10%.

[3] The high strength galvanized steel sheet according to [1] or [2], wherein the steel sheet includes a decarburized layer.

[4] The high strength galvanized steel sheet according to any one of [1] to [3], including a metal plating layer on at least one side of the steel sheet and between the steel sheet and the galvanizing layer.

[5] The high strength galvanized steel sheet according to [4], wherein the metal plating layer has a chemical composition comprising Fe and inevitable impurities.

[6] The high strength galvanized steel sheet according to [5], wherein the chemical composition of the metal plating layer further contains at least one element selected from the group consisting of B, C, P, N, O, Ni, Mn, Mo, Zn, W, Pb, Sn, Cr, V, and Co in an amount of not more than 10 mass % in total.

[7] The high strength galvanized steel sheet according to any one of [1] to [6], wherein the high strength galvanized steel sheet is a hot-dip galvanized steel sheet or a hot-dip galvannealed steel sheet.

[8] A member that is obtained using the high strength galvanized steel sheet according to any one of [1] to [7].

[9] A method for producing the high strength galvanized steel sheet according to [1] or [2], the method comprising: hot rolling a steel slab having the chemical composition according to [1] or [2], and coiling a hot rolled steel sheet thus obtained at coiling temperature of 350 to 700° C., cold rolling the hot rolled steel sheet thus coiled to obtain a cold rolled steel sheet, and subjecting the cold rolled steel sheet to first heat treatment, galvanizing treatment, and second heat treatment in this order, wherein in the first heat treatment, the cold rolled steel sheet is heated at heating temperature T3 of 750 to 950° C., and cooled from the heating temperature T3 to cooling stop temperature T4 of 350 to 550° C. while an average cooling rate v1 from the heating temperature T3 to 550° C. is not lower than 10° C./s, in the second heat treatment, the cold rolled steel sheet is cooled to cooling stop temperature T5 of 50 to 350° C. and thereafter re-heated to re-heating temperature T6 of higher than the cooling stop temperature T5 and 300 to 500° C., followed by cooling to (Ms point-200° C. to 50° C. at an average cooling rate v2 satisfying Formula (1) below, and in the first heat treatment, the galvanizing treatment, and the second heat treatment, retaining time $t_1$ in a temperature range T1 of 300° C. or higher and lower than 450° C. and retaining time $t_2$ in a temperature range T2 of 450° C. or higher and 600° C. or lower satisfy Formula (2) below, $$v2 \leq 3.8\ [C] + 2.4\ [Mn] + 1.2\ [Si] \quad (1)$$

$$1.1 \leq 3t_1/t_2 \leq 6.5 \quad (2)$$

where [C], [Mn], and [Si] in the Formula (1) respectively represent C content, Mn content, and Si content in the chemical composition, the content being in a unit of mass %.

[10] The method according to [9] for producing the high strength galvanized steel sheet, wherein in the first heat treatment, the cold rolled steel sheet is heated at the heating temperature T3 in an atmosphere having a dew point of higher than −30° C. to form a decarburized layer at an uppermost layer of the cold rolled steel sheet.

[11] The method according to [9] or for producing the high strength galvanized steel sheet, wherein before the first heat treatment, the cold rolled steel sheet is subjected to metal plating treatment to form a metal plating layer on at least one side of the cold rolled steel sheet.

[12] The method according to for producing the high strength galvanized steel sheet, wherein the metal plating layer has a chemical composition comprising Fe and inevitable impurities.

[13] The method according to for producing the high strength galvanized steel sheet, wherein the chemical composition of the metal plating layer further contains at least one element selected from the group consisting of B, C, P, N, O, Ni, Mn, Mo, Zn, W, Pb, Sn, Cr, V, and Co in an amount of not more than 10 mass % in total.

[14] The method according to any one of [9] to for producing the high strength galvanized steel sheet, wherein the galvanizing treatment is hot-dip galvanizing treatment or hot-dip galvannealing treatment.

[15] A method for producing a member, the method comprising subjecting the high strength galvanized steel sheet according to any one of [1] to [7] to at least one of forming processing or joining processing to obtain the member.

Aspects of the present invention can provide a high strength galvanized steel sheet having a tensile strength of not less than 1,320 MPa and also having excellent formability and fatigue strength of a spot welding portion.

DETAILED DESCRIPTION OF EMBODIMENTS OF THE INVENTION

[High Strength Galvanized Steel Sheet]

Figure 1:
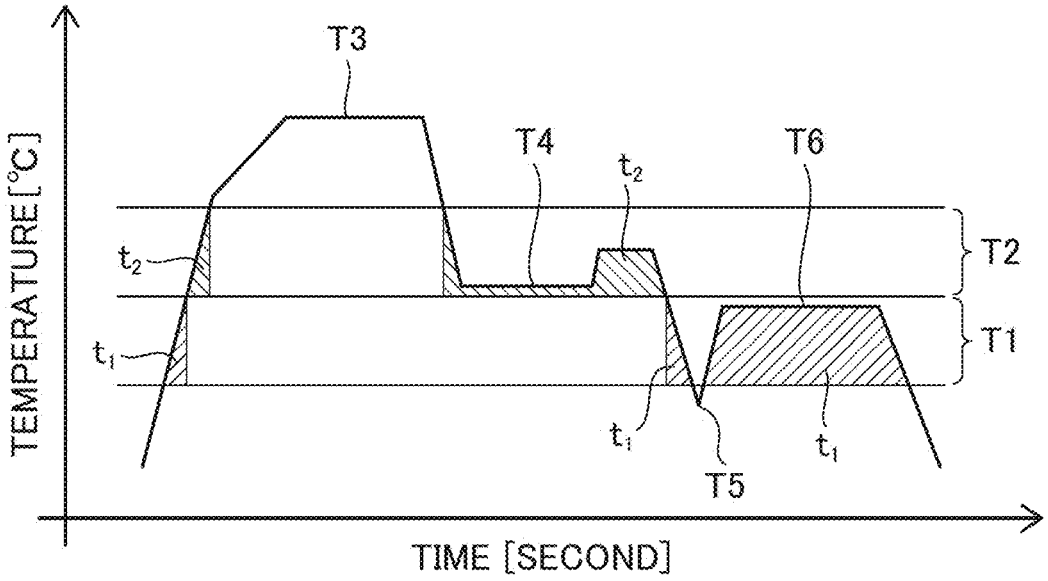
FIG. 1 is a chart showing an example of first heat treatment, galvanizing treatment, and second heat treatment.

A high strength galvanized steel sheet according to aspects of the invention includes a steel sheet (base steel sheet) and a galvanizing layer, and the steel sheet has a chemical composition and a microstructure described later and satisfies an amount of diffusible hydrogen in steel described later.

The term "high strength" means having a tensile strength (TS) of not less than 1,320 MPa.

Hereinafter, the "high strength galvanized steel sheet" may also be simply referred to as "galvanized steel sheet."

The high strength galvanized steel sheet according to aspects of the invention has a tensile strength of not less than 1,320 MPa and also has excellent formability and fatigue strength of a spot welding portion. Accordingly, since collision strength can be sufficiently maintained, the high strength galvanized steel sheet is suitably used in a transporter such as an automobile.

As a method of forming the high strength galvanized steel sheet according to aspects of the invention, a general processing method such as press working can be adopted with no limitation. As a method of welding the high strength galvanized steel sheet according to aspects of the invention, a general welding method such as spot welding or arc welding can be adopted with no limitation.

<Steel Sheet>

First, the steel sheet (base steel sheet) constituting the galvanized steel sheet is described.

An example of the steel sheet is a cold rolled steel sheet having undergone second heat treatment described later.

The thickness of the steel sheet is not particularly limited and is, for example, not less than 0.5 mm and not more than 3.0 mm.

<<Chemical Composition>>

The chemical composition of the steel sheet (hereinafter, also called "chemical composition according to aspects of the invention" for convenience) is described.

In the chemical composition according to aspects of the invention, "%" means "mass" unless otherwise noted.

(C: 0.150 to 0.450%)

C leads to generation of martensite and raises strength of the steel sheet. When an amount of C is too small, hardness of martensite is lowered, and the total area fraction of tempered martensite and bainite decreases; therefore, the tensile strength of not less than 1,320 MPa cannot be achieved. Hence, the amount of C is not less than 0.150%, preferably not less than 0.180%, and more preferably not less than 0.190%.

Meanwhile, an excessive amount of C leads to generation of excessive cementite at a heat-affected portion, lowers the toughness of a spot welding portion, and thus lowers the fatigue strength of the spot welding portion. Hence, the amount of C is not more than 0.450%, preferably not more than 0.400%, and more preferably not more than 0.370%.

(Si: 0.80 to 3.00%)

Si improves strength of a steel sheet through solid-solution strengthening. To achieve the tensile strength of not less than 1,320 MPa, an amount of Si is not less than 0.80%, preferably not less than 1.00%, and more preferably not less than 1.10%.

Meanwhile, an excessive amount of Si lowers the toughness of a spot welding portion and thus lowers the fatigue strength of the spot welding portion. In addition, there is a concern that an excessive amount of Si lowers resistance to resistance-weld cracking (described later) at a spot welding portion. Hence, the amount of Si is not more than 3.00%, preferably not more than 2.60%, and more preferably not more than 2.40%.

(Mn: 2.00 to 4.00%)

Mn improves strength of a steel sheet through solid-solution strengthening. To achieve the tensile strength of not less than 1,320 MPa, an amount of Mn is not less than 2.00%, preferably not more than 2.20%, and more preferably not less than 2.40%.

Meanwhile, an excessive amount of Mn leads to generation of excessive cementite in tempering process, lowers the toughness of a spot welding portion, and thus lowers the fatigue strength of the spot welding portion. Hence, the amount of Mn is not more than 4.00%, preferably not more than 3.60%, and more preferably not more 3.50%.

(P: Not More than 0.100%)

P is segregated in a grain boundary, lowers the toughness of a spot welding portion, and thus lowers the fatigue strength of the spot welding portion. Hence, an amount of P is not more than 0.100%, preferably not more than 0.030%, and more preferably not more than 0.010%.

(S: Not More than 0.0200%)

S bonds to Mn to form coarse MnS, lowers the toughness of a spot welding portion, and thus lowers the fatigue strength of the spot welding portion. Hence, an amount of S is not more than 0.0200%, preferably not more than 0.0100%, and more preferably not more than 0.0020%.

(Al: Not More than 0.100%)

Al acts as a deoxidizer. An excessive amount of Al leads to aggregation and coarsening of oxides or nitrides, thereby lowering the toughness of a spot welding portion and lowering the fatigue strength of the spot welding portion. Hence, the amount of Al is not more than 0.100%, preferably not more than 0.080%, and more preferably not more than 0.060%.

The lower limit of the amount of Al is not particularly limited and is, for example, 0.010%, and preferably 0.020% in order to achieve the effect of addition of Al.

(O: Not More than 0.0100%)

O forms an oxide, lowers the toughness of a spot welding portion, and thus lowers the fatigue strength of the spot welding portion. Hence, an amount of 0 is not more than 0.0100%, preferably not more than 0.0050%, and more preferably not more than 0.0020%.

(N: Not More than 0.0100%)

N bonds to Ti and forms TiN. An excessive amount of N lowers the toughness of a spot welding portion and thus lowers the fatigue strength of the spot welding portion, due to formation of a large amount of TiN. Hence, the amount of N is not more than 0.0100%, preferably not more than 0.0080%, and more preferably not more than 0.0060%.

The chemical composition according to aspects of the invention contains the above-described components with the balance of Fe and inevitable impurities.

(Other Elements)

In place of part of the balance (Fe and inevitable impurities), the chemical composition according to aspects of the invention may further contain, by mass, at least one element (also referred to as "optional element") selected from the group consisting of the following elements.

((B: Not More than 0.0050%))

B is an element capable of improving hardenability of a steel sheet through segregation in the austenite grain boundary, increases the tensile strength of the steel sheet, and is thus preferably added.

Meanwhile, an excessive amount of B leads to formation of $Fe_{23}(CB)_6$, lowers the toughness of a spot welding portion, and thus lowers the fatigue strength of the spot welding portion. Hence, the amount of B is preferably not more than 0.0050%, more preferably not more than 0.0040%, and yet more preferably not more than 0.0030%.

The lower limit of the amount of B is not particularly limited and is, for example, 0.0005%, and preferably 0.0010% in order to achieve the effect of addition of B.

((Ti: Not More than 0.200%))

Ti forms fine carbides, nitrides, or carbonitrides during hot rolling process or heat treatment, thereby enhancing tensile strength of a steel sheet, and is thus preferably added.

Meanwhile, an excessive amount of Ti leads to formation of coarse nitrides when Ti bonds to N, and thus lowers the toughness of a spot welding portion and the fatigue strength of the spot welding portion. Hence, the amount of Ti is preferably not more than 0.200%, more preferably not more than 0.100%, and yet more preferably not more than 0.050%.

The lower limit of the amount of Ti is not particularly limited and is, for example, 0.005%, and preferably 0.010% in order to achieve the effect of addition of Ti.

((Nb: Not More than 0.200%, V: Not More than 0.500%, W: Not More than 0.500%))

Nb, V, and W form fine carbides, nitrides, or carbonitrides during hot rolling process or heat treatment, thereby enhancing tensile strength of a steel sheet, and are thus preferably added.

Meanwhile, when an amount of these elements is excessively large, they are not dissolved when a steel slab is heated and remain as coarse carbides. Coarse carbides lower the toughness of a spot welding portion and thus lower the fatigue strength of the spot welding portion.

Hence, an amount of Nb is preferably not more than 0.200%, more preferably not more than 0.100%, and yet more preferably not more than 0.050%. The lower limit thereof is not particularly limited and is, for example, 0.005%, and preferably 0.010% in order to achieve the effect of addition of Nb.

An amount of V is preferably not more than 0.500%, more preferably not more than 0.300%, and yet more preferably not more than 0.100%. The lower limit thereof is not particularly limited and is, for example, 0.005%, and preferably 0.010% in order to achieve the effect of addition of V.

An amount of W is preferably not more than 0.500%, more preferably not more than 0.200%, and yet more preferably not more than 0.050%. The lower limit thereof is not particularly limited and is, for example, 0.001%, and preferably 0.002% in order to achieve the effect of addition of W.

((Mo: Not More than 1.000%, Cr: Not More than 1.000%))

Mo and Cr improve hardenability of a steel sheet, thereby increasing the tensile strength of the steel sheet, and are thus preferably added. Meanwhile, when an amount of these elements is excessively large, hard martensite is excessively generated, lowering the toughness of a spot welding portion and thus the fatigue strength of the spot welding portion.

Hence, an amount of Mo is preferably not more than 1.000%, more preferably not more than 0.700%, and yet more preferably not more than 0.400%. The lower limit thereof is not particularly limited and is, for example, 0.005%, and preferably 0.020% in order to achieve the effect of addition of Mo.

An amount of Cr is preferably not more than 1.000%, more preferably not more than 0.700%, and yet more preferably not more than 0.400%. The lower limit thereof is not particularly limited and is, for example, 0.005%, and preferably 0.020% in order to achieve the effect of addition of Cr.

((Sb: Not More than 0.200%, Sn: Not More than 0.200%))

Sb and Sn suppress decarburization in a steel sheet surface to thereby increase tensile strength of a steel sheet and are thus preferably added. Meanwhile, when an amount of these elements is excessively large, steel is embrittled, causing generation of cracks at a heat-affected portion and thus lowering fatigue strength of a spot welding portion.

Hence, an amount of Sb is preferably not more than 0.200%, more preferably not more than 0.080%, and yet more preferably not more than 0.040%. The lower limit thereof is not particularly limited and is, for example, 0.001%, and preferably 0.002% in order to achieve the effect of addition of Sb.

An amount of Sn is preferably not more than 0.200%, more preferably not more than 0.080%, and yet more preferably not more than 0.040%. The lower limit thereof is not particularly limited and is, for example, 0.001%, and preferably 0.002% in order to achieve the effect of addition of Sn.

((Zr: Not More than 0.1000%))

Zr leads to formation of spherical precipitates to thereby improve the toughness of a spot welding portion, and is thus preferably added. Meanwhile, when an amount of Zr is excessively large, more coarse precipitates remain in a non-solid solution state through heat treatment of a steel slab in hot rolling process, lowering the toughness of a spot welding portion and thus the fatigue strength of the spot welding portion.

Hence, the amount of Zr is preferably not more than 0.1000%, more preferably not more than 0.0700%, and yet more preferably not more than 0.0400%. The lower limit thereof is not particularly limited and is, for example, 0.0005%, and preferably 0.0010% in order to achieve the effect of addition of Zr.

((Cu: Not More than 1.000%))

Cu improves hardenability of a steel sheet, thereby increasing tensile strength of the steel sheet, and is thus preferably added. Meanwhile, when an amount of Cu is excessively large, Cu inclusions are increased to thereby lower the toughness of a spot welding portion and thus the fatigue strength of the spot welding portion.

Hence, the amount of Cu is preferably not more than 1.000%, more preferably not more than 0.700%, and yet more preferably not more than 0.400%. The lower limit thereof is not particularly limited and is, for example, 0.005%, and preferably 0.010% in order to achieve the effect of addition of Cu.

((Ni: Not More than 1.000%))

Ni improves hardenability of a steel sheet, thereby increasing tensile strength of the steel sheet, and is thus preferably added. Meanwhile, when an amount of Ni is excessively large, hard martensite is increased to thereby lower the toughness of a spot welding portion and thus the fatigue strength of the spot welding portion.

Hence, the amount of Ni is preferably not more than 1.000%, more preferably not more than 0.700%, and yet more preferably not more than 0.400%. The lower limit thereof is not particularly limited and is, for example, 0.003%, and preferably 0.005% in order to achieve the effect of addition of Ni.

((Ca: Not More than 0.0050%, Mg: Not More than 0.0050%, REM: not More than 0.0050%))

Ca, Mg, and a rare earth metal (REM) leads to formation of spherical precipitates such as sulfides and oxides to thereby improve the toughness of a spot welding portion, and are thus preferably added. Meanwhile, when an amount of these elements is excessively large, sulfides are coarsened to thereby lower the toughness of a spot welding potion and thus the fatigue strength of the spot welding portion.

Hence, an amount of Ca is preferably not more than 0.0050%, more preferably not more than 0.0045%, and yet more preferably not more than 0.0040%. The lower limit thereof is not particularly limited and is, for example, 0.0005%, and preferably 0.0010% in order to achieve the effect of addition of Ca.

An amount of Mg is preferably not more than 0.0050%, more preferably not more than 0.0048%, and yet more preferably not more than 0.0045%. The lower limit thereof is not particularly limited and is, for example, 0.0005%, and preferably 0.0010% in order to achieve the effect of addition of Mg.

An amount of REM is preferably not more than 0.0050%, more preferably not more than 0.0040%, and yet more preferably not more than 0.0030%. The lower limit thereof is not particularly limited and is, for example, 0.0005%, and preferably 0.0010% in order to achieve the effect of addition of REM.

((Co: Not More than 0.30%))

Co leads to formation of spherical precipitates to thereby improve the toughness of a spot welding portion, and is thus preferably added. Meanwhile, when an amount of Co is excessively large, hard martensite is increased to thereby lower the toughness of a spot welding portion and thus the fatigue strength of the spot welding portion.

Hence, the amount of Co is preferably not more than 0.30%, more preferably not more than 0.20%, and yet more preferably not more than 0.10%. The lower limit thereof is not particularly limited and is, for example, 0.01%, and preferably 0.02% in order to achieve the effect of addition of Co.

((Ta: Not More than 0.10%))

Ta leads to formation of spherical precipitates to thereby improve the toughness of a spot welding portion, and is thus preferably added. Meanwhile, when an amount of Ta is excessively large, coarse carbides are increased to thereby lower the toughness of a spot welding potion and thus the fatigue strength of the spot welding portion.

Hence, the amount of Ta is preferably not more than 0.10%, more preferably not more than 0.088, and yet more preferably not more than 0.068. The lower limit thereof is not particularly limited and is, for example, 0.01%, and preferably 0.02% in order to achieve the effect of addition of Ta.

((as: Not More than 0.100%, Pb: Not More than 0.100%, Zn: Not More than 0.100%, and Bi: Not More than 0.100%))

As, Pb, Zn, and Bi lead to formation of spherical precipitates to thereby improve the toughness of a spot welding portion, and are thus preferably added. Meanwhile, when an amount of these elements is excessively large, a large amount of coarse precipitates or inclusions are generated to thereby lower the toughness of a spot welding portion and thus the fatigue strength of the spot welding portion.

Hence, an amount of As is preferably not more than 0.100%, more preferably not more than 0.050%, and yet more preferably not more than 0.010%. The lower limit thereof is not particularly limited and is, for example, 0.001%, and preferably 0.002% in order to achieve the effect of addition of As.

An amount of Pb is preferably not more than 0.100%, more preferably not more than 0.050%, and yet more preferably not more than 0.010%. The lower limit thereof is not particularly limited and is, for example, 0.001%, and preferably 0.002% in order to achieve the effect of addition of Pb.

An amount of Zn is preferably not more than 0.100%, more preferably not more than 0.050%, and yet more preferably not more than 0.010%. The lower limit thereof is not particularly limited and is, for example, 0.001%, and preferably 0.002% in order to achieve the effect of addition of Zn.

An amount of Bi is preferably not more than 0.100%, more preferably not more than 0.050%, and yet more preferably not more than 0.010%. The lower limit thereof is not particularly limited and is, for example, 0.001%, and preferably 0.002% in order to achieve the effect of addition of Bi.

((Hf: Not More than 0.10%))

Hf leads to formation of spherical precipitates to thereby improve the toughness of a spot welding portion, and is thus preferably added. Meanwhile, when an amount of Hf is excessively large, coarse carbides are increased to thereby lower the toughness of a spot welding potion and thus the fatigue strength of the spot welding portion.

Hence, an amount of Hf is preferably not more than 0.10%, more preferably not more than 0.08%, and yet more preferably not more than 0.06%. The lower limit thereof is not particularly limited and is, for example, 0.01%, and preferably 0.02% in order to achieve the effect of addition of Hf.

When the chemical composition according to aspects of the invention contains the above-described optional elements in amounts less than the foregoing lower limits, the elements are regarded as being contained as inevitable impurities.

<<Microstructure>>

Next, the microstructure of the steel sheet (hereinafter, also referred to as "microstructure according to aspects of the invention" for convenience) is described.

Even if the foregoing chemical composition according to aspects of the invention is satisfied, it is not sufficient to achieve the effect according to aspects of the invention; it is necessary to satisfy the microstructure according to aspects of the invention described below.

Hereinbelow, an area fraction refers to an area fraction with respect to the entire microstructure. An area fraction of each structure is determined according to the method described in Examples below.

(Total Area Fraction of Tempered Martensite and Bainite: 60 to 95%)

In order to stably ensure the tensile strength of not less than 1,320 MPa, this total area fraction of tempered martensite and bainite is not less than 60%, preferably not less than 65%, more preferably not less than 70%.

Meanwhile, when this total area fraction is too high, the area fraction of retained austenite is low, and ductility of a steel sheet is lowered to thus lower formability of the steel sheet. Hence, the total area fraction is not more than 95%, preferably not more than 92%, and more preferably not more than 88%.

(Area Fraction of Retained Austenite: 5 to 30%)

Retained austenite improves the ductility of a steel sheet. Hence, the area fraction of retained austenite is not less than 5%, preferably not less than 6%, and more preferably not less than 8%.

Meanwhile, when the area fraction of retained austenite is too high, more retained austenite undergoes martensite transformation when receiving stress, and cracks are generated at a heat-affected portion to thus lower the fatigue strength of a spot welding portion. Hence, the area fraction of retained austenite is not more than 30%, preferably not more than 25%, and more preferably not more than 20%.

(Area Fraction of Retained Austenite Having Aspect Ratio of 5.5 or Higher: Not more than 50%)

With stress being repeatedly applied thereto, retained austenite transforms into hard martensite through work hardening. When an amount of retained austenite having an aspect ratio of 5.5 or higher is excessive, stress is concentrated on tip parts of martensite having been transformed, and voids are likely to be generated. Since voids are joined together to thereby easily generate cracks around a nugget, the fatigue strength of a spot welding portion is lowered.

In addition, since retained austenite having an aspect ratio of 5.5 or higher is unstable, an excessive amount thereof hinders achievement of the effect of transformation induced plasticity (TRIP) by retained austenite, whereby the ductility is lowered.

Hence, the area fraction of retained austenite having an aspect ratio of 5.5 or higher with respect to the entire retained austenite is not more than 50%, preferably not more than 45%, and more preferably not more than 40%. Meanwhile, the lower limit of the area fraction of retained austenite having an aspect ratio of 5.5 or higher with respect to the entire retained austenite is not particularly limited and is, for example, 28, and preferably 4%.

(Area Fraction of Fresh Martensite Having Diameter of 2.0 μm or Less: Not More than 20%)

Fine fresh martensite enhances the strength of a steel sheet. To achieve this effect, fresh martensite is defined to have a diameter of 2.0 μm or less.

Meanwhile, an excessive amount of fresh martensite having a diameter of 2.0 μm or less causes generation of voids due to a hardness difference in the structure, whereby the formability is lowered. Since voids are joined together to thereby easily generate cracks around a nugget, the fatigue strength of a spot welding portion is lowered. Hence, the area fraction of fresh martensite having a diameter of 2.0 μm or less is not more than 20%, preferably not more than 17%, and more preferably not more than 15%.

Meanwhile, the lower limit of the area fraction of fresh martensite having a diameter of 2.0 μm or less is not particularly limited and is, for example, 18, and preferably 3%.

The microstructure according to aspects of the invention may contain, in addition to tempered martensite, bainite, retained austenite, and fresh martensite, another structure (remaining structure) such as perlite, ferrite, iron-based carbonitride, alloy carbonitride, MnS, $Al_2O_3$, or other inclusions, or another known structure.

The area fraction of the remaining structure is preferably not more than 10%, more preferably not more than 8%, and yet more preferably not more than 5%. When the area fraction of the remaining structure falls within this range, the effects according to aspects of the invention would not be impaired.

<<Amount of Diffusible Hydrogen in Steel: Not More than 0.60 Mass ppm>>

With an excessive amount of diffusible hydrogen in steel, a spot welding portion easily cracks in the welding process, the fatigue strength of the spot welding portion is thus lowered. Hence, the amount of diffusible hydrogen in steel is not more than 0.60 mass ppm, preferably not more than 0.50 mass ppm, and more preferably not more than 0.40 mass ppm.

The amount of diffusible hydrogen in steel is determined according to the method described in Examples below.

<<Decarburized Layer>>

When a galvanized steel sheet is subjected to spot welding (resistance welding), there is a concern as described below.

That is, in the resistance welding process, residual stress is generated in the vicinity of a spot welding portion, zinc in a galvanizing layer is melt in this state and diffuses to enter crystal grain boundaries of a steel sheet, whereby liquid metal embrittlement (LME) occurs, possibly resulting in intergranular cracking (LME cracking) in the steel sheet. When the steel sheet contains Si (when an amount of Si is particularly large), LME cracking is likely to occur.

Accordingly, a galvanized steel sheet is sometimes required to have excellent resistance to such cracking (hereinafter, also referred to as "resistance to resistance-weld cracking at a spot welding portion," "resistance to resistance-weld cracking at a welding portion," or simply "resistance to resistance-weld cracking").

Hence, a steel sheet (base steel sheet) constituting a galvanized steel sheet preferably includes, at its uppermost layer, a decarburized layer having a low C concentration. With this constitution, the galvanized steel sheet is excellent in resistance to resistance-weld cracking at a spot welding portion.

While the reason thereof is not clear, it is presumed that since the decarburized layer is viscous due to the low C concentration, the above-described cracking hardly occurs.

When a steel sheet includes a decarburized layer, the thickness of the decarburized layer (depth in the sheet thickness direction) is, for example, not less than 10 μm. Because the resistance to resistance-weld cracking at a spot welding portion is more excellent, the thickness of the decarburized layer (depth in the sheet thickness direction) is preferably not less than 20 μm, more preferably not less than 30 μm, and yet more preferably not less than 40 μm.

Meanwhile, the upper limit of the thickness of the decarburized layer is not particularly limited. However, in order to obtain a tensile strength of the steel sheet in a preferable range, the thickness of the decarburized layer is preferably not more than 130 μm, more preferably not more than 100 μm, and yet more preferably not more than 70 μm.

The decarburized layer (and the thickness thereof) is determined as follows.

First, the C concentration is measured in the sheet thickness direction from the interface between the galvanizing layer and the steel sheet (interface between the galvanizing layer and a metal plating layer to be described later in a case where the galvanized steel sheet includes the metal plating layer; the same applies hereinafter).

The C concentration is measured using an electron probe micro analyzer (EPMA).

Specifically, first, a galvanized steel sheet embedded in resin is polished, and a cross section perpendicular to the rolling direction is finished for observation. The galvanized steel sheet is then taken out from resin and used as a sample.

With an acceleration voltage of 7 kV and a probe current of 50 nA, a portion of 300×300 μm in the cross section of the sample including the uppermost layer of the steel sheet is subjected to area analysis or line analysis at 1 μm-step to measure the C intensity.

To suppress contamination in the measurement, before the measurement is started, a plasma cleaner is used in two places, the measurement chamber and the sample preparation chamber, to remove hydrocarbon from the sample surface and the surrounding thereof.

To suppress accumulation of hydrocarbon during the measurement, the sample is heated on a stage in the measurement chamber, and the measurement is performed while the sample is retained at temperature up to 100° C.

It is checked that the lowest detection limit of C is sufficiently lower than 0.10 mass % because of the effect of suppressing contamination.

The used apparatus and the method for suppressing contamination are detailed in Reference Literature 1 described below.

Reference Literature 1: Yamashita et al., "Analysis of Carbon Partitioning at an Early Stage of Proeutectoid Ferrite Transformation in a Low Carbon Mn—Si Steel by High Accuracy FE-EPMA," Iron and Steel, The Iron and Steel Institute of Japan, 2017, Vol. 103, No. 11, p. 14 to 20.

Meanwhile, contamination suppression depends on the type of apparatus used, conditions, and other factors and is thus not essentially required, and it suffices if the C intensity can be measured at a sufficient accuracy.

Next, the C intensity thus measured is converted to a C concentration (unit: mass %), and a concentration map is obtained. The conversion makes use of the calibration curve that is preliminarily prepared using the standard sample.

From the obtained concentration map, a line profile in the sheet thickness direction is extracted. Line profiles at 300 sites along a direction parallel to the steel sheet surface (direction perpendicular to the sheet thickness direction) are averaged to thereby obtain a profile of the C concentration in the sheet thickness direction.

The obtained profile of the C concentration in the sheet thickness direction is subjected to smoothing treatment using the simple moving average method. The number of points for smoothing is about 21.

In the profile having undergone the smoothing treatment, a region where the C concentration is not more than 80 mass % of the maximum value is defined as the decarburized layer, and the distance of the region in the sheet thickness direction is defined as the thickness of the decarburized layer.

The average value of measurement results at 2 fields in each sample is used.

<Galvanizing Layer>

A galvanizing layer is formed by galvanizing treatment described later.

The coating weight of the galvanizing layer is preferably 20 to 80 g/m$^2$ per one side.

<Metal Plating Layer>

The high tensile galvanized steel sheet according to aspects of the invention may further include a metal plating layer (plating layer different from the foregoing galvanizing layer) at least on one side of the steel sheet and between the steel sheet and the galvanizing layer.

With this constitution, the resistance to resistance-weld cracking at a spot welding portion is excellent.

The reason thereof is not clear but is presumably because the metal plating layer suppresses diffusion and entrance of zinc (Zn) of the galvanizing layer into the steel sheet in the resistance welding process (zinc entrance suppressing effect).

While examples of metal used for the metal plating layer include metals such as Fe and Ni having a higher melting point than that of Zn, Fe is preferred because, in addition to the zinc entrance suppressing effect described above, the following effect can be expected.

Specifically, the metal plating layer is preferably a metal plating layer having a chemical composition containing Fe and inevitable impurities (hereinafter, also referred to as "Fe-based plating layer").

The chemical composition of the Fe-based plating layer may further contain at least one element selected from the group consisting of B, C, P, N, O, Ni, Mn, Mo, Zn, W, Pb, Sn, Cr, V, and Co in an amount of not more than 10 mass % in total.

When an amount of Si at the steel sheet surface is large, presumably, the toughness of a spot welding portion is lowered, and the resistance to resistance-weld cracking thereof is easily degraded.

In this case, it is presumed that by providing the Fe-based plating layer on the steel sheet surface, the Fe-based plating layer serves as a solid solution Si-deficient layer; as a result, an amount of Si dissolved in a spot welding portion decreases, and the toughness of the spot welding portion is thus prevented from lowering, whereby the resistance to resistance-weld cracking is more excellent (toughness lowering suppressing effect).

In addition, it is presumed that the Fe-based plating layer functions as a soft layer and relieves stress applied to the steel sheet surface in the spot welding process to reduce residual stress of the spot welding portion, whereby the resistance to resistance-weld cracking is more excellent (stress relief effect).

In order to improve the resistance to resistance-weld cracking at a spot welding portion, a metal plating layer such as the Fe-based plating layer is preferably provided on the surface of the steel sheet having the decarburized layer described above.

The coating weight of the metal plating layer per one side is, for example, more than 0 $g/m^2$, preferably not less than 2.0 $g/m^2$, more preferably not less than 4.0 $g/m^2$, and yet more preferably not less than 6.0 $g/m^2$.

While the upper limit thereof is not particularly limited, in view of the cost, the coating weight of the metal plating layer per one side is preferably not more than 60 $g/m^2$, more preferably not more than 50 $g/m^2$, yet more preferably not more than 40 $g/m^2$, and particularly preferably not more than 30 $g/m^2$.

The coating weight of the metal plating layer is determined as described below.

A specimen of 10 mm×15 mm is sampled from a galvanized steel sheet including the metal plating layer and embedded in resin to obtain an embedded sample having a cross section of the galvanized steel sheet exposed. Arbitrary 3 sites in this cross section are observed using a scanning electron microscope (SEM) at an acceleration voltage of 15 kV and at a magnification of 2,000 to 10,000× depending on the thickness of the metal plating layer. The average value of the thicknesses of the metal plating layer at 3 fields is multiplied by the specific gravity of the metal to calculate the coating weight of the metal plating layer per one side.

[Evaluation Test of Resistance to Resistance-weld Cracking at Spot Welding Portion]

The test method for evaluating the resistance to resistance-weld cracking at a spot welding portion is described with reference to FIGS. 2 to 4.

Figure 2:
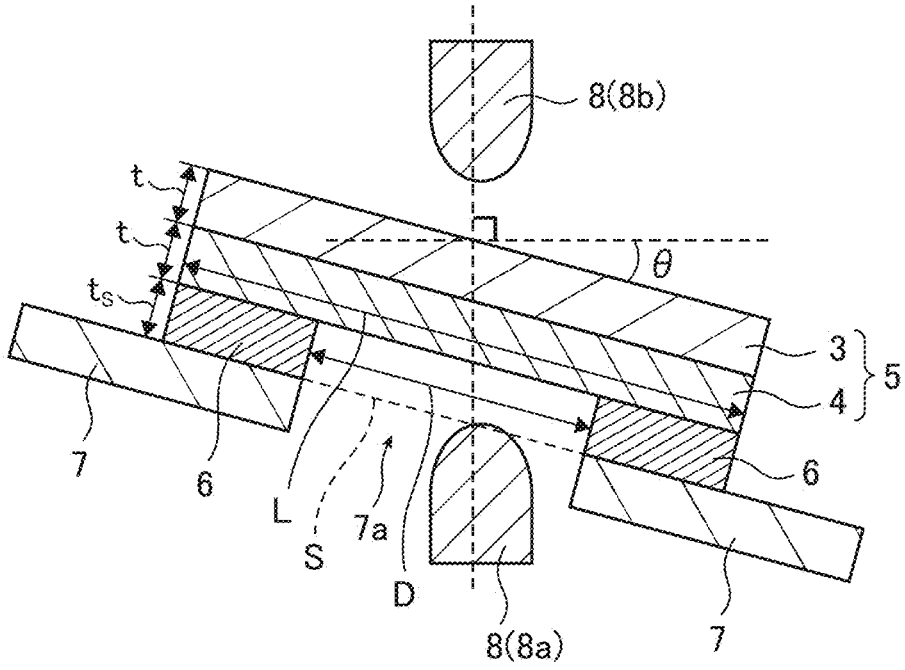
FIG. 2 is a cross-sectional view showing a sheet assembly used in resistance welding.

FIG. 2 shows a cross-sectional view showing a sheet assembly 5 used in resistance welding. FIG. 3 is a plan view showing the sheet assembly 5 having undergone resistance welding. FIG. 4 is a cross-sectional view taken along line A-A of FIG. 3.

First, a specimen 4 is cut from a galvanized steel sheet that is an evaluation target. With the direction perpendicular (TD) to the rolling direction being a longitudinal direction and the rolling direction being a transverse direction, the specimen 4 has a size of longitudinal direction length L: 150 mm, transverse direction length as width W: 50 mm, and thickness t: 1.6 mm.

Similarly, a counter specimen 3 having the same size is cut from another galvanized steel sheet.

An evaluation-target surface (galvanizing layer surface) of the specimen 4 is brought into contact with the galvanizing layer of the counter specimen 3, whereby the sheet assembly 5 is obtained.

The sheet assembly 5 is fixed to a fixing table 7 via a pair of spacers 6 constituted of steel sheets (longitudinal direction length: 50 mm, transverse direction length: 45 mm, thickness $t_s$: 2.0 mm). The spacers 6 are disposed such that their end surfaces in the longitudinal direction are aligned with the opposite end surfaces in the transverse direction of the sheet assembly 5. Hence, the distance D between the pair of spacers 6 is 60 mm. The fixing table 7 is a single sheet having a hole 7*a* formed in the center part thereof.

Next, while the sheet assembly 5 is pressurized by a pair of electrodes 8 (tip diameter: 6 mm), the sheet assembly 5 being warped is subjected to resistance welding by use of a servomotor pressurizing-type resistance welder with a single phase alternating current (50 Hz).

More specifically, resistance welding is performed under predetermined conditions (pressure, holding time, and welding time) at a welding current at which a predetermined nugget diameter d is achieved, whereby a welding portion including a nugget 9 is formed.

The holding time means a time period from the termination of applying welding current to the start of releasing the electrodes 8.

The nugget diameter d is a distance between the opposite end portions of the nugget 9 in the longitudinal direction of the sheet assembly 5.

When resistance welding is performed, the pair of electrodes 8 pressurize the sheet assembly 5 in the vertical direction from the upper and lower sides.

A lower electrode 8*a* pressurizes the specimen 4 through the hole 7*a* of the fixing table 7. For the pressurizing process, the lower electrode 8*a* and the fixing table 7 are fixed at a position at which the lower electrode 8*a* makes contact with a virtual plane S extending from a contact surface between the spacers 6 and the fixing table 7. An upper electrode 8*b* is movable at a position at which the upper electrode 8*b* can make contact with a center part of the counter specimen 3.

Resistance welding is performed with the sheet assembly 5 being tilted to the longitudinal direction side of the sheet assembly 5 by 5 degrees with respect to the horizontal direction (that is, angle θ with respect to the horizontal direction being 5 degrees).

Figure 3:
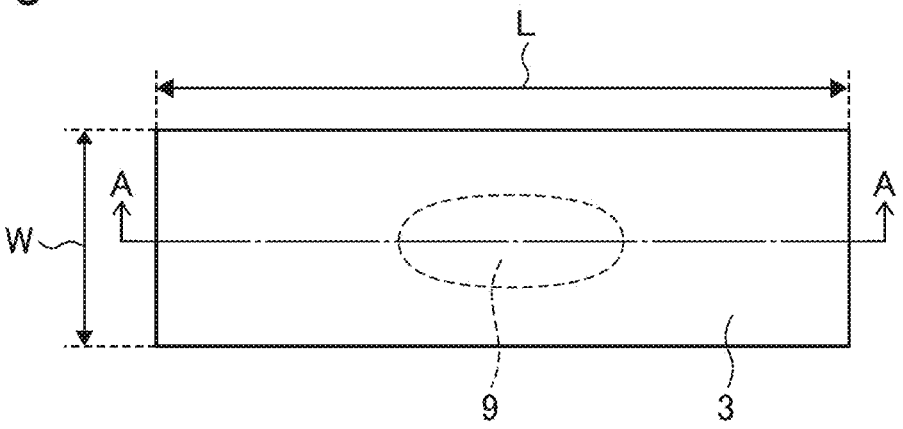
FIG. 3 is a plan view showing the sheet assembly having undergone resistance welding.

The sheet assembly 5 having undergone resistance welding is cut along line A-A of FIG. 3 such that the cross section includes the center of the welding portion including the nugget 9. The cross section of the welding portion is observed with an optical microscope (200×), and the resistance to resistance-weld cracking at the welding portion is evaluated.

Figure 4:
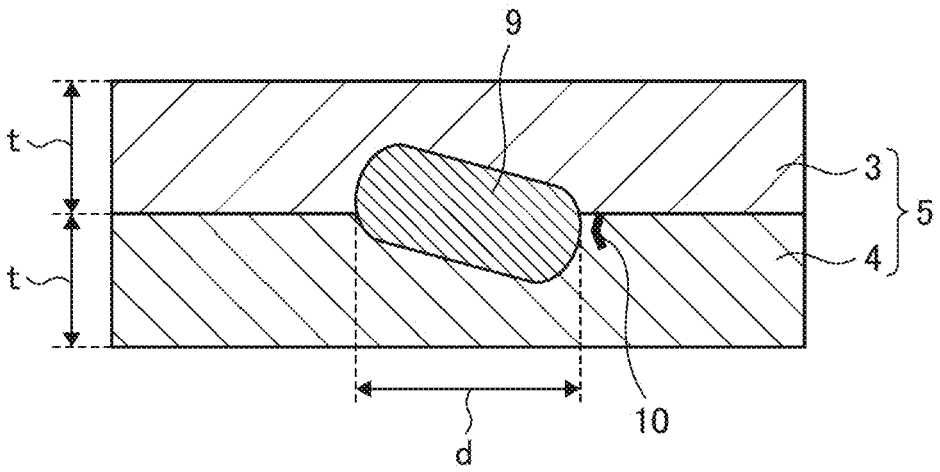
FIG. 4 is a cross-sectional view taken along line A-A of FIG. 3.

FIG. 4 schematically shows a crack 10 generated in the specimen 4.

When a crack is generated in the counter specimen 3, the stress on the specimen 4 is dispersed, and hence a proper evaluation cannot be obtained. Therefore, data of the cases where no cracks are generated in the counter specimen 3 is used.

[Method for Producing High Strength Galvanized Steel Sheet]

Next, a method for producing a high strength galvanized steel sheet according to aspects of the invention (hereinafter, also referred to as "production method according to aspects of the invention" for convenience) is described. The production method according to aspects of the invention is a method for producing the above-described high strength galvanized steel sheet according to aspects of the invention.

Hereinafter, any temperature in the process of heating or cooling a steel sheet (hot rolled steel sheet, cold rolled steel sheet) or the like means a surface temperature thereof unless otherwise noted.

A smelting method for making a steel slab (steel material) is not particularly limited, and a known smelting method using, for example, a converter or an electric furnace is applicable. Following the smelting, a steel slab is preferably obtained by the continuous casting method. Meanwhile, a steel slab may be obtained using another known casting method such as the ingot casting-blooming method or the thin slab continuous casting method.

In the production method according to aspects of the invention, first, a steel slab having the above-described chemical composition is subjected to hot rolling. A hot rolled steel sheet is thus obtained.

In the hot rolling process, the steel slab may be rolled after being reheated in a heating furnace. In a case where the steel slab has a temperature higher than a predetermined temperature, the steel slab may be subjected to direct rolling without being heated.

<Hot Rolling>

In the hot rolling process, rough rolling and finish rolling are performed on the steel slab.

Before the rough rolling, the steel slab is preferably heated to melt carbides in the steel slab.

In view of melting carbides and preventing an increase in the rolling load, the temperature to heat the steel slab (steel slab heating temperature) is preferably not lower than 1,100° C., and more preferably not lower than 1,150° C.

Meanwhile, in view of preventing an increase in the scale loss, the steel slab heating temperature is preferably not higher than 1, 300° C., and more preferably not higher than 1,280° C.

As described above, when the steel slab before the rough rolling has a temperature higher than a predetermined temperature and has carbides therein being melted, the process of heating the steel slab before the rough rolling can be omitted.

Conditions for the rough rolling and the finish rolling are not particularly limited, and, for example, the finish rolling termination temperature is preferably 700 to 1,100° C., and more preferably 800 to 1,000° C.

<<Coiling Temperature: 350 to 700° C.>>

Next, the hot rolled steel sheet obtained through the hot rolling process of the steel slab is coiled.

When the temperature at which the hot rolled steel sheet is coiled (coiling temperature) is too low, hard martensite having a high carbon concentration is generated, and thus an amount of coarse fresh martensite is increased after the heat treatment. Moreover, if a hard hot rolled steel sheet mainly formed of martensite is subjected to cold rolling, the fatigue strength of a spot welding portion would be lowered.

Hence, the coiling temperature is not lower than 350° C., preferably not lower than 400° C., and more preferably not lower than 450° C.

Meanwhile, when the coiling temperature is too high, ferrite and perlite are excessively generated in the microstructure of the hot rolled steel sheet, nucleation sites of austenite during the heat treatment decrease (i.e., the total area fraction of tempered martensite and bainite decreases), and therefore it is difficult to ensure the desired strength after the heat treatment.

Hence, the coiling temperature is not higher than 700° C., preferably not higher than 650° C., and more preferably not higher than 600° C.

<Cold Rolling>

Subsequently, the hot rolled steel sheet thus coiled is subjected to cold rolling, whereby a cold rolled steel sheet is obtained.

The rolling rate in the cold rolling is preferably not less than 30%, and more preferably not less than 35%. The upper limit thereof is not particularly limited and is, for example, not more than 70%, and preferably not more than 65%.

<Metal Plating Treatment>

The cold rolled steel sheet obtained through the cold rolling may be subjected to metal plating treatment before a first heat treatment described later is performed. Through this treatment, the above-described metal plating layer is formed on at least one side of the cold rolled steel sheet. The formed metal plating layer is preferably the Fe-based plating layer described above.

The metal plating treatment is not particularly limited and is preferably electroplating treatment from the viewpoint of productivity. Examples of the metal plating bath used in the electroplating treatment include a sulfuric acid bath, a hydrochloric acid bath, and a bath having both bathes mixed. When the electroplating treatment is performed, the coating weight of the formed metal plating layer can be adjusted by, for example, current application time.

When the Fe-based plating layer is formed by the metal plating treatment, a Fe-based plating bath is used.

The Fe-based plating bath contains, for instance, Fe and at least one element selected from the group consisting of B, C, P, N, O, Ni, Mn, Mo, Zn, W, Pb, Sn, Cr, V, and Co. An amount of these elements is appropriately adjusted depending on the chemical composition of the Fe-based plating layer to be formed.

In the Fe-based plating bath, the metal elements may be contained as metal ions, and a non-metal element can be contained as part of boric acid, phosphoric acid, nitric acid, organic acid, or the like.

When an iron sulfate plating bath is used as the Fe-based plating bath, the bath may further contain a conduction assisting agent such as sodium sulfate or potassium sulfate, a chelating agent, a pH buffer or another agent.

The cold rolled steel sheet prior to the metal plating treatment may be subjected to degreasing and water washing to clean a surface of the cold rolled steel sheet. In addition, pickling and water washing may further be performed in order to activate the surface of the cold rolled steel sheet.

The method of degreasing and water washing is not particularly limited, and any conventionally known method may be employed.

For pickling, various acid liquids of, for example, sulfuric acid, hydrochloric acid, nitric acid, and a mixture thereof may be used, and among those, sulfuric acid, hydrochloric acid, or a mixture thereof is preferred. The concentration of the acid liquid is not particularly limited and is preferably 1 to 20 mass % in consideration of, for example, oxide coating removing capability and prevention of surface damages (surface defects) due to excessive pickling. A defoaming agent, a pickling promoter, a pickling inhibitor, or another agent may be added to the acid liquid.

Next, the cold rolled steel sheet obtained through the cold rolling (or the cold rolled steel sheet having undergone the metal plating treatment) is subjected to the first heat treatment, galvanizing treatment, and a second heat treatment in this order, each of which treatments is described below.

<First Heat Treatment>

In the first heat treatment, the cold rolled steel sheet is heated at heating temperature T3 described later, and thereafter cooled to cooling stop temperature T4 described later. This cooling process includes cooling at an average cooling rate v1 described later.

<<Heating Temperature T3: 750 to 950° C.>>

When the heating temperature T3 is too low, heating is carried out in a dual phase region of ferrite and austenite, whereby the resulting microstructure contains ferrite, and the total area fraction of tempered martensite and bainite decreases. Therefore, it is difficult to ensure the desired tensile strength. Hence, the heating temperature T3 is not lower than 750° C., preferably not lower than 800° C., and more preferably not lower than 830° C.

Meanwhile, when the heating temperature T3 is too high, the hydrogen partial pressure increases to increase an amount of hydrogen entering steel, whereby the amount of diffusible hydrogen in steel increases. Hence, the heating temperature is not higher than 950° C., preferably not higher than 930° C., and more preferably not higher than 900° C.

A time period during which the cold rolled steel sheet is retained at the heating temperature T3 (heating time) is not particularly limited and is, for example, 10 to 500 seconds, preferably 50 to 300 seconds, and more preferably 80 to 200 seconds.

<<Dew Point: Higher than −30° C.>>

The dew point of the atmosphere when the cold rolled steel sheet is heated at the heating temperature T3 may be higher than −30° C.

With this constitution, decarburization reaction of the cold rolled steel sheet is promoted, and the C concentration in the uppermost layer of the cold rolled steel sheet can be decreased. In other words, the above-described decarburized layer can be formed. In this case, the resulting galvanized steel sheet has excellent resistance to resistance-weld cracking at a spot welding portion.

The dew point is preferably not lower than −20° C., and more preferably not lower than −5° C., because the thickness of the formed decarburized layer increases, and the resistance to resistance-weld cracking at a spot welding portion is more excellent.

The upper limit of the dew point is not particularly limited. Meanwhile, in order to suppress oxidation of a surface of the cold rolled steel sheet and improve adhesion of the galvanizing layer formed by the galvanizing treatment described later, the dew point is preferably not higher than 40° C., more preferably not higher than 30° C., and yet more preferably not higher than 20° C.

<<Average Cooling Rate v1: Not lower than 10° C./s>>

The cold rolled steel sheet heated at the heating temperature T3 is next cooled to the cooling stop temperature T4 described later. In this process, the average cooling rate from the heating temperature T3 to 550° C. is defined as v1.

When the average cooling rate v1 is too low, ferrite transformation occurs during the cooling process, which leads to a decreased total area fraction of tempered martensite and bainite, and therefore it is difficult to ensure the desired tensile strength. Hence, the average cooling rate v1 is not lower than 10° C./s, preferably not lower than 11° C./s, and more preferably not lower than 13° C./s.

The upper limit of the average cooling rate v1 is not particularly limited and is, for example, 45° C./s, and preferably 30° C./s.

<<Cooling Stop Temperature T4: 350 to 550° C.>>

When the cooling stop temperature T4 is too low, the total fraction area of tempered martensite and bainite excessively increases, which leads to a decreased area fraction of retained austenite, and thus ductility of the steel sheet (cold rolled steel sheet) is lowered, thereby lowering the formability. Hence, the cooling stop temperature T4 is not lower than 350° C., preferably not lower than 370° C., and more preferably not lower than 390° C.

Meanwhile, when the cooling stop temperature T4 is too high, perlite is generated, which leads to a decreased area fraction of retained austenite, and thus ductility of the steel sheet (cold rolled steel sheet) is lowered, thereby lowering the formability. Hence, the cooling stop temperature T4 is not higher than 550° C., preferably not higher than 530° C., and more preferably not higher than 510° C.

<Galvanizing Treatment>

The cold rolled steel sheet having undergone the first heat treatment (hereinafter, also simply referred to as "cold rolled steel sheet") is next subjected to galvanizing treatment, whereby a galvanizing layer is formed on a surface thereof.

A preferred galvanizing treatment is hot-dip galvanizing treatment or hot-dip galvannealing treatment.

For performing the galvanizing treatment, use may be made of an apparatus configured such that heat treatment (first heat treatment and second heat treatment) and galvanizing treatment can be continuously carried out.

Hereinafter, suitable conditions for the galvanizing treatment are described.

Meanwhile, the production method according to aspects of the invention requires that retaining time $t_1$ and retaining time $t_2$ described later satisfy the conditions described later.

In a case where hot-dip galvanizing treatment is performed, for example, the cold rolled steel sheet is dipped in a zinc bath having bath temperature of 440 to 500° C. Thereafter, the coating weight of the galvanizing layer (hot-dip galvanizing layer) is preferably adjusted by, for example, gas wiping.

A preferred zinc bath has a chemical composition containing Al in an amount of 0.10 to 0.23 mass % with the balance of Zn and inevitable impurities.

In a case where hot-dip galvannealing treatment is performed, when the alloying temperature is too low, the Zn—Fe alloying rate is excessively lowered, thereby sometimes causing significant difficulty in alloying. Meanwhile, when the alloying temperature is too high, untransformed austenite is transformed into perlite, thereby sometimes lowering tensile strength and ductility. Hence, the alloying temperature is preferably 450 to 600° C., more preferably 470 to 550° C., and yet more preferably 470 to 530° C.

The coating weight of the galvanizing layer on a hot-dip galvanized steel sheet (GI) and a hot-dip galvannealed steel sheet (GA) is preferably 20 to 80 g/m$^2$ per one side.

<Second Heat Treatment>

In the second heat treatment, the cold rolled steel sheet having undergone the galvanizing treatment (hereinafter, also simply referred to as "cold rolled steel sheet") is cooled to cooling stop temperature T5 described later, re-heated to a re-heating temperature T6 described later, and thereafter cooled to at least 50° C. This cooling process (hereinafter, also referred to as "re-cooling") includes cooling at an average cooling rate v2 described later.

<<Cooling Stop Temperature T5: 50 to 350° C.>>

When the cooling stop temperature T5 is too low, the area fraction of retained austenite decreases, and the ductility of the steel sheet (cold rolled steel sheet) is lowered, thereby lowering formability. Hence, the cooling stop temperature T5 is not lower than 50° C., preferably not lower than 100° C., and more preferably not lower than 120° C.

Meanwhile, when the cooling stop temperature T5 is too high, the area faction of fresh martensite having a diameter of 2.0 μm or less excessively increases. Hence, the cooling stop temperature 5 is preferably not higher than 350° C. and more preferably not higher than 300° C.

Here, once the cold rolled steel sheet is cooled to the cooling stop temperature T5, the temperature of the cold rolled steel sheet may be immediately raised to re-heating temperature T6 described later, without being retained at the cooling stop temperature T5. Alternatively, the temperature may be retained at the cooling stop temperature T5 for a certain period of time and thereafter raised to the re-heating temperature T6 described later.

<<Re-heating Temperature T6: Higher than Cooling Stop Temperature T5 and 300 to 500° C.>>

The re-heating temperature T6 exceeds the cooling stop temperature T5 and falls within the range of 300 to 500° C. With this constitution, distribution of carbon to untransformed austenite from martensite generated when being cooled to the cooling stop temperature T5 is promoted, whereby a desired area fraction of retained austenite can be obtained.

<<Average Cooling Rate v2: v2≤3.8 [C]+2.4 [Mn]+1.2 [Si]>>

The average cooling rate satisfying the following Formula (1) from the temperature (Ms point-200° C. to 50° C. in the cooling process (re-cooling process) from the re-heating temperature T6 to at least 50° C. is defined as v2.

In the production method according to aspects of the invention, the average cooling rate v2 satisfies the following Formula (1).

$$v2 \leq 3.8\ [C] + 2.4\ [Mn] + 1.2\ [Si] \quad (1)$$

In Formula (1) above, [C], [Mn], and [Si] respectively express C, Mn, and Si contents (unit: mass %) in the foregoing chemical composition (chemical composition according to aspects of the invention).

When the average cooling rate v2 satisfies Formula (1) above, martensite generated in the re-cooling process is self-tempered, and fine carbides are generated in martensite. As a result, the area fraction of fresh martensite having a diameter of 2.0 μm or less can be small in the resulting microstructure.

The lower limit of the average cooling rate v2 is not particularly limited and is, for example, 1° C./s, and preferably 2° C./s.

The Ms point (unit: ° C.) is determined by Formula (3) below.

$$Ms = 550 - 350 \times [C] - 40 \times [Mn] - 35 \times [V] - 20 \times [Cr] - 17 \times [Ni] - 10 \times [Cu] - 10 \times [Mo] - 5 \times [W] + 15 \times [Co] + 30 \times [Al] \quad (3)$$

In Formula (3) above, [X] is the element X content (unit: mass %) in the foregoing chemical composition (chemical composition according to aspects of the invention).

<Relation Between Retaining Time $t_1$ and Retaining Time $t_2$: $1.1 \leq 3\ t_1/t_2 \leq 6.5$>

FIG. 1 shows a chart showing an example of the first heat treatment, the galvanizing treatment, and the second heat treatment described above. In FIG. 1, shown are the heating temperature T3, cooling stop temperature T4, the cooling stop temperature T5, and the re-heating temperature T6 described above.

In addition, FIG. 1 shows a temperature range T1 of 300° C. or higher and lower than 450° C., and a temperature range T2 of 450° C. or higher and 600° C. or lower.

The retaining time (staying time) of the cold rolled steel sheet in the temperature range T1 is defined as $t_1$. The retaining time $t_1$ is shown by hatch lines extending obliquely from an upper right position to a lower left position in FIG. 1.

The retaining time (staying time) of the cold rolled steel sheet in the temperature range T2 is defined as $t_2$. The retaining time $t_2$ is shown by hatch lines extending obliquely from an upper left position to a lower right position in FIG. 1.

In the production method according to aspects of the invention, the retaining time $t_1$ and the retaining time $t_2$ satisfy Formula (2) below.

$$1.1 \leq 3t_1/t_2 \leq 6.5 \quad (2)$$

When the value of $3\ t_1/t_2$ is set to be not smaller than a certain value, bainite transformation proceeds, and carbon in retained austenite is concentrated, leading to an increased amount of retained austenite having a small aspect ratio with which retained austenite is stable. In other words, the area fraction of retained austenite having an aspect ratio of 5.5 or higher can be reduced.

Specifically, the value of $3\ t_1/t_2$ is not smaller than 1.1, preferably not smaller than 1.3, and more preferably not smaller than 1.5.

Meanwhile, when the value of $3\ t_1/t_2$ is too large, bainite transformation excessively proceeds, and therefore the total area fraction of tempered martensite and bainite excessively increases.

Hence, the value of $3\ t_1/t_2$ is not larger than 6.5, preferably not larger than 6.3, and more preferably not larger than 6.1.

The retaining time $t_1$ in the temperature range T1 is not particularly limited as long as the value of $3\ t_1/t_2$ satisfies Formula (2) above and is, for example, 10 to 110 seconds, preferably 20 to 100 seconds, and more preferably 30 to 90 seconds.

The retaining time $t_2$ in the temperature range T2 is also not particularly limited as long as the value of $3\ t_1/t_2$ satisfies Formula (2) above and is, for example, 10 to 100 seconds, preferably 20 to 90 seconds, and more preferably 30 to 80 seconds.

In the first heat treatment, the galvanizing treatment, and the second heat treatment described above, a time period for which the cold rolled steel sheet is retained at each of the temperatures (such as the cooling stop temperature T4 and the re-heating temperature T6) is not particularly limited as long as the value of $3\ t_1/t_2$ satisfies Formula (2) above.

In the production method according to aspects of the invention, the retaining temperature of the heating temperature, the re-heating temperature or the like is not necessarily constant as long as the temperature falls within the above-described temperature range. The cooling rate may vary during the cooling process within the above-described rate range. As long as the conditions such as the temperature range described above are satisfied, the heat treatment may be performed by any equipment.

[Member and Production Method Thereof]

Next, described is a member formed using the foregoing high strength galvanized steel sheet according to aspects of the invention (hereinafter, also referred to as "member according to aspects of the invention").

The member according to aspects of the invention is obtained by having the high strength galvanized steel sheet according to aspects of the invention subjected to at least one of forming processing or joining processing.

The forming processing is not particularly limited and is, for example, a general forming processing such as press working.

The joining processing is not particularly limited, and examples thereof include welding such as spot welding, laser welding, and arc welding; rivet joining, and interlock joining.

Conditions for the forming processing and the joining processing are not particularly limited and may adopt those of an ordinary method.

EXAMPLES

Aspects of the invention are specifically described below with reference to Examples. However, the invention is not limited to the examples described below.

Test Example 1

<Production of Galvanized Steel Sheet>

Molten steel having each chemical composition shown in Tables 1 to 2 below with the balance being Fe and inevitable impurities was made in a converter, and a steel slab was obtained by a continuous casting method. It should be noted that Table 2 below is a continuation of Table 1 below, and underlines in Tables 1 to 2 indicate those outside of the ranges of the invention (the same applies to other tables).

The obtained steel slab was subjected to hot rolling under the conditions described in Table 3 below, and a hot rolled steel sheet was obtained. Specifically, the steel slab was heated to 1,250° C. and roughly rolled. Next, finish rolling was performed at the finish rolling termination temperature of 900° C., and the steel was coiled at the coiling temperature shown in Table 3 below.

The thus coiled hot rolled steel sheet was subjected to cold rolling at the rolling rate shown in Table 3 below, whereby a cold rolled steel sheet was obtained.

The obtained cold rolled steel sheet was subjected to the first heat treatment, the galvanizing treatment, and the second heat treatment under the conditions shown in Table 3.

In every example, the cold rolled steel sheet was retained at the heating temperature T3 in an atmosphere having a dew point of not lower than −30° C. for 100 seconds. In addition, in every example, after the cold rolled steel sheet was cooled to the cooling stop temperature T5, the temperature thereof was immediately raised to the re-heating temperature T6 without being retained at the cooling stop temperature T5.

In the galvanizing treatment, the hot-dip galvanizing treatment or the hot-dip galvannealing treatment was performed on both sides of the cold rolled steel sheet having undergone the first heat treatment, whereby the hot-dip galvanized steel sheet (GI) or the hot-dip galvannealed steel sheet (GA) was obtained.

As the hot-dip galvanizing bath, a zinc bath containing Al in an amount of 0.20 mass % with the balance being Zn and inevitable impurities was used when GI was produced, while a zinc bath containing Al in an amount of 0.14 mass % with the balance being Zn and inevitable impurities was used when GA was produced.

The bath temperature was 470° C. in both of GI and GA productions.

The coating weight of the galvanizing layer was 45 to 72 $g/m^2$ per one side when GI was produced and was 45 $g/m^2$ per one side when GA was produced.

When GA was produced, the alloying temperature was 530° C.

The composition of the galvanizing layer of GI contained Fe in an amount of 0.1 to 1.0 mass %, and Al in an amount of 0.2 to 1.0 mass %, with the balance being Fe and inevitable impurities. The composition of the galvanizing layer of GA contained Fe in an amount of 7 to 15 mass %, and Al in an amount of 0.1 to 1.0 mass %, with the balance being Fe and inevitable impurities.

Hereinafter, the galvanized steel sheet (hot-dip galvanized steel sheet (GI) or hot-dip galvannealed steel sheet (GA)) having undergone the second heat treatment is also simply referred to as "galvanized steel sheet."

<Observation of Microstructure>

In the galvanized steel sheet thus obtained, the microstructure of the steel sheet was observed according to the below procedure. The results are shown in Table 4 below.

<<Area Fractions of Tempered Martensite, Bainite, and Fresh Martensite>>

The obtained galvanized steel sheet was polished such that a cross section (L cross section) parallel to the rolling direction would become an observation surface. After being etched using 1 vol % Nital, the observation surface was observed while being enlarged at a magnification of 3,000× using a scanning electron microscope (SEM). At the position corresponding to ¼ of the sheet thickness from a surface of the steel sheet in the L cross section, 10 fields were observed to obtain SEM images.

In the SEM images thus obtained, an area fraction of each microstructure was determined, and the average area fraction of the 10 fields was defined as the area fraction of each microstructure. For the SEM image analysis, Image-Pro manufactured by Media Cybernetics Inc. was used as analysis software.

In the SEM image of each field, portions taking on dark gray color were determined to be tempered martensite and bainite, and the total area fraction of them (unit: %) was obtained.

Similarly, in the SEM image of each field, portions taking on white or light gray color were determined to be fresh martensite and retained austenite.

From their structures, retained austenite having face-centered cubic structure (fcc) was excluded. Specifically, electron backscatter diffraction (EBSD) data of the field was acquired, the fcc structure was excluded based on the data, and the remaining structure was determined to be fresh martensite.

Thereafter, in the SEM image, an area of each structure that was determined to be fresh martensite was determined. Based on the determined area, a circle equivalent diameter of each fresh martensite was obtained and was defined as a diameter of the fresh martensite. The area fraction (unit: %) of fresh martensite having a diameter of 2.0 μm or less was obtained in this manner.

<<Area Fraction of Retained Austenite>>

The observation surface (L cross section at the position corresponding to ¼ of the sheet thickness) was observed by the X-ray diffraction method. As the incident X-ray, a Co Kα ray source was used. The diffraction intensity ratio of each of (200), (220), and (311) planes of fcc iron (austenite) to each of (200), (211), and (220) planes of bcc iron was determined. The value obtained by averaging the 9 ratios thus determined was defined as the volume fraction of retained austenite.

The obtained volume fraction was defined as the area fraction (unit: %) of retained austenite.

<<Area Fraction of Retained Austenite Having Aspect Ratio of 5.5 Or Higher>>

Of the observation surface (L cross section at the position corresponding to ¼ of the sheet thickness), EBSD data (phase map data) was acquired, and fcc structures were identified and defined as retained austenite grains. With a region of 30 μm×30 μm in the observation surface being one field, data was acquired at 10 fields that were isolated from one another by at least 50 μm.

Of each retained austenite grain, the longest grain length was defined as the long axis length a, while the grain length of the longest distance traversing the grain in the direction perpendicular to the long axis length a was defined as the short axis length b, and a/b was defined as an aspect ratio. When plural grains are in contact with one another, they were divided approximately evenly and were treated as separate grains.

The area of retained austenite having an aspect ratio (a/b) of 5.5 or higher was determined, and a ratio thereof with respect to the area of the whole retained austenite in the same field was determined. The average value of the obtained ratios of 10 fields was defined as the area fraction (unit: %) of retained austenite having an aspect ratio of 5.5 or higher with respect to the whole retained austenite.

<Evaluation>

The obtained galvanized steel sheet was evaluated according to the following method. The results are shown in Table 4 below.

<<Tensile Test>>

From the obtained galvanized steel sheet, taken was a No. 5 specimen according to JIS Z 2201 with the longitudinal direction (tensile direction) thereof coinciding with the direction at 90° to the rolling direction. Using the specimen thus sampled, a tensile test was performed in accordance with JIS Z 2241 five times, and the tensile strength (TS) and the butt elongation (EL) were determined based on the average values of the five measurements. When the TS is 1,320 MPa or more, the strength can be rated as high. When the EL is 10.0% or more, the formability can be rated as excellent.

<<Hole Expanding Test>>

The obtained galvanized steel sheet was subjected to a hole expanding test in accordance with JIS Z 2256.

Specifically, the obtained galvanized steel sheet was first sheared to sample a specimen of 100 mm×100 mm. In the specimen thus sampled, a hole with a diameter of 10 mm was punched with a clearance of 12.58. Then, using a die with an internal diameter of 75 mm, a 60-degree cone punch was pressed into the hole with the specimen being held with a blank holding force of 9 tons (88.26 kN), and a hole diameter Df (unit: mm) was measured at the crack initiation limit. Having the initial hole diameter as Do (unit: mm), the hole expanding ratio A (unit: %) was determined by the following equation. When A is 20% or more, the formability can be rated as excellent.

$$\lambda = \{(D_f - D_0)/D_0\} \times 100$$

<<Measurement of Amount of Diffusible Hydrogen In Steel of Steel Sheet>>

From the obtained galvanized steel sheet, the galvanizing layer was removed using a router (precision grinder), and thereafter a specimen having a length of 30 mm and a width of 5 mm was sampled. The specimen thus sampled was subjected to the thermal desorption analysis, and an amount of diffusible hydrogen in steel of the steel sheet was measured. The heating rate was 200° C./hr. An accumulated value of amount of hydrogen detected in a temperature range from room temperature (25° C.) to less than 210° C. was defined as an amount (unit: mass ppm) of diffusible hydrogen in steel. The amount of diffusible hydrogen in steel of the steel sheet is preferably not more than 0.60 mass ppm.

<<Fatigue Test of Spot Welding Portion>>

Using the obtained galvanized steel sheet, a cross tension testing specimen having a spot welding portion was prepared and subjected to a fatigue test according to JIS Z 3138.

First, spot welding was performed under the conditions of electrode: DR 6 mm-40R, pressure: 4802 N (490 kgf), and current application time: 17 cycles, the current value was adjusted such that a nugget diameter would be 6.5 mm, and the cross tension testing specimen was prepared.

A load was applied under the conditions of minimum/maximum load ratio of 0.05, frequency of 20 Hz, and number of repetitions of 107 times, and thereafter the cross tension testing was performed at a tension rate of 5 mm/min. Based on the highest cross tension strength with which peeling did not occur in the specimen, the fatigue strength of a spot welding portion was evaluated.

Specifically, when the cross tension strength was 250N or more, "A" was placed, when the cross tension strength was 180N or more and less than 250N, "B" was placed, and when the cross tension strength was less than 180N, "C" was placed in Table 4 below. "A" or "B" can be rated as excellent fatigue strength of a spot welding portion.

TABLE 1

| Steel reference | Chemical composition [mass %] | | | | | | | | | | | | | | | |
|---|---|---|---|---|---|---|---|---|---|---|---|---|---|---|---|---|
| symbol | C | Si | Mn | P | S | Al | N | O | B | Ti | Nb | V | W | Mo | Cr | Sb |
| A | 0.225 | 1.21 | 3.04 | 0.006 | 0.0005 | 0.041 | 0.0040 | 0.0007 | 0.0013 | 0.021 | 0.022 | — | — | — | — | — |
| B | 0.220 | 1.25 | 3.01 | 0.004 | 0.0008 | 0.036 | 0.0041 | 0.0010 | — | — | 0.018 | — | — | — | — | 0.010 |
| C | 0.241 | 1.41 | 2.74 | 0.005 | 0.0005 | 0.040 | 0.0039 | 0.0020 | — | — | — | 0.092 | — | — | — | — |
| D | 0.155 | 1.52 | 3.86 | 0.004 | 0.0012 | 0.052 | 0.0042 | 0.0060 | — | — | — | — | 0.022 | — | — | — |
| E | 0.226 | 2.78 | 2.86 | 0.012 | 0.0015 | 0.045 | 0.0048 | 0.0006 | — | — | 0.049 | — | — | 0.199 | — | — |
| F | 0.365 | 1.52 | 2.82 | 0.010 | 0.0011 | 0.042 | 0.0051 | 0.0050 | 0.0047 | 0.020 | — | — | — | — | — | — |
| G | 0.255 | 1.45 | 2.72 | 0.006 | 0.0007 | 0.031 | 0.0067 | 0.0030 | — | — | — | — | — | — | — | — |

TABLE 1-continued

| Steel reference symbol | Chemical composition [mass %] C | Si | Mn | P | S | Al | N | O | B | Ti | Nb | V | W | Mo | Cr | Sb |
|---|---|---|---|---|---|---|---|---|---|---|---|---|---|---|---|---|
| H | 0.235 | 1.32 | 1.91 | 0.007 | 0.0019 | 0.029 | 0.0035 | 0.0004 | — | — | — | 0.022 | — | — | — | — |
| I | 0.235 | 1.35 | 4.21 | 0.013 | 0.0020 | 0.041 | 0.0041 | 0.0006 | — | — | 0.031 | — | — | — | — | — |
| J | 0.452 | 1.30 | 2.72 | 0.015 | 0.0015 | 0.036 | 0.0038 | 0.0006 | — | — | — | — | — | — | — | — |
| K | 0.144 | 1.31 | 2.72 | 0.018 | 0.0012 | 0.055 | 0.0059 | 0.0006 | — | — | — | — | — | — | — | — |
| L | 0.307 | 1.53 | 2.53 | 0.008 | 0.0010 | 0.039 | 0.0035 | 0.0006 | — | — | — | — | — | — | 0.208 | 0.009 |
| M | 0.242 | 3.20 | 2.69 | 0.006 | 0.0020 | 0.032 | 0.0051 | 0.0015 | — | — | — | — | — | — | — | — |
| N | 0.242 | 0.71 | 2.62 | 0.009 | 0.0010 | 0.058 | 0.0034 | 0.0016 | — | — | — | — | — | — | — | — |
| O | 0.223 | 1.22 | 2.89 | 0.010 | 0.0020 | 0.032 | 0.0041 | 0.0004 | — | — | — | — | — | — | — | — |
| P | 0.225 | 1.23 | 2.92 | 0.005 | 0.0020 | 0.041 | 0.0038 | 0.0006 | — | — | — | — | — | — | — | — |
| Q | 0.223 | 1.32 | 2.95 | 0.015 | 0.0150 | 0.054 | 0.0042 | 0.0004 | — | — | — | — | — | — | — | — |
| R | 0.312 | 1.50 | 2.55 | 0.016 | 0.0010 | 0.042 | 0.0051 | 0.0015 | — | — | — | — | — | — | — | — |
| S | 0.220 | 1.35 | 2.72 | 0.012 | 0.0010 | 0.031 | 0.0034 | 0.0016 | — | 0.092 | — | — | — | — | — | — |
| T | 0.362 | 1.53 | 2.86 | 0.010 | 0.0009 | 0.029 | 0.0052 | 0.0004 | — | — | — | — | — | — | — | — |
| U | 0.256 | 2.76 | 2.68 | 0.015 | 0.0016 | 0.041 | 0.0041 | 0.0004 | — | — | — | — | — | — | — | — |
| V | 0.255 | 0.95 | 2.68 | 0.006 | 0.0014 | 0.036 | 0.0092 | 0.0006 | — | — | — | — | — | — | — | — |
| W | 0.221 | 1.24 | 3.72 | 0.009 | 0.0011 | 0.036 | 0.0038 | 0.0004 | — | — | — | — | — | — | — | — |
| X | 0.223 | 1.23 | 2.15 | 0.010 | 0.0020 | 0.040 | 0.0025 | 0.0009 | — | — | — | — | — | — | — | — |

TABLE 2

| Steel reference symbol | Chemical composition [mass %] Sn | Zr | Cu | Ni | Ca | Mg | Co | Ta | REM | Hf | As | Pb | Zn | Bi | Ms [° C.] | 3.8[C] + 2.4[Mn] + 1.2[Si] |
|---|---|---|---|---|---|---|---|---|---|---|---|---|---|---|---|---|
| A | — | — | — | — | — | — | — | — | — | — | — | — | — | — | 351 | 9.6 |
| B | — | — | — | — | — | — | — | — | — | — | — | — | — | — | 354 | 9.6 |
| C | — | — | — | — | — | — | — | — | — | — | — | — | — | — | 354 | 9.2 |
| D | — | — | — | — | — | — | — | — | — | — | — | — | — | — | 343 | 11.7 |
| E | — | — | — | — | — | — | — | — | — | — | — | — | — | — | 356 | 11.1 |
| F | — | — | 0.120 | — | — | — | — | — | — | — | — | — | — | — | 310 | 10.0 |
| G | — | — | — | — | — | — | — | — | — | — | — | — | — | — | 353 | 9.2 |
| H | — | — | — | — | — | — | — | — | — | — | — | — | — | — | 391 | 7.1 |
| I | — | — | — | — | — | — | — | — | — | — | — | — | — | — | 301 | 12.6 |
| J | — | — | — | — | — | — | — | — | — | — | — | — | — | — | 284 | 9.8 |
| K | — | — | — | — | — | — | — | — | — | — | — | — | — | — | 392 | 8.6 |
| L | — | — | — | — | — | — | — | — | — | — | — | — | — | — | 338 | 9.1 |
| M | — | — | — | — | — | — | — | — | — | — | — | — | — | — | 359 | 11.2 |
| N | — | — | — | — | — | — | — | — | — | — | — | — | — | — | 362 | 8.1 |
| O | 0.010 | 0.0220 | — | — | — | — | — | — | — | — | — | — | — | — | 357 | 9.2 |
| P | — | — | 0.220 | 0.125 | — | — | — | — | — | — | — | — | — | — | 351 | 9.3 |
| Q | — | — | — | — | 0.0012 | 0.0020 | — | — | — | — | — | — | — | — | 356 | 9.5 |
| R | — | — | — | — | — | — | 0.05 | — | — | — | — | — | — | — | 341 | 9.1 |
| S | — | — | — | — | — | — | — | 0.03 | 0.0010 | — | — | — | — | — | 365 | 9.0 |
| T | — | — | — | — | — | — | — | — | — | 0.03 | 0.005 | — | — | — | 310 | 10.1 |
| U | — | — | — | — | — | — | — | — | — | — | — | 0.005 | — | — | 354 | 10.7 |
| V | — | — | — | — | — | — | — | — | — | — | — | — | 0.004 | — | 355 | 8.5 |
| W | — | — | 0.360 | — | — | — | — | — | — | — | — | — | — | 0.013 | 325 | 11.3 |
| X | — | — | — | — | — | — | — | — | — | — | — | — | — | 0.004 | 387 | 7.5 |

TABLE 3

| No. | Steel reference symbol | Hot rolling: Steel slab heating temperature [° C.] | Finish rolling termination temperature [° C.] | Coiling temperature [° C.] | Cold rolling Rolling rate [%] | First heat treatment: Heating temperature T3 [° C.] | Average cooling rate v1 [° C./s] | Cooling stop temperature T4 [° C.] |
|---|---|---|---|---|---|---|---|---|
| 1 | A | 1250 | 900 | 500 | 45 | 870 | 20 | 480 |
| 2 | A | 1250 | 900 | 500 | 46 | 870 | 20 | 480 |
| 3 | A | 1250 | 900 | 500 | 45 | 870 | 20 | 480 |
| 4 | A | 1250 | 900 | 500 | 45 | 870 | 20 | 480 |
| 5 | B | 1250 | 900 | 500 | 50 | 865 | 20 | 470 |
| 6 | B | 1250 | 900 | 500 | 50 | 865 | 19 | 470 |
| 7 | B | 1250 | 900 | 340 | 50 | 865 | 20 | 470 |
| 8 | B | 1250 | 900 | 720 | 50 | 865 | 20 | 470 |
| 9 | C | 1250 | 900 | 510 | 45 | 870 | 21 | 460 |
| 10 | C | 1250 | 900 | 510 | 45 | 960 | 21 | 460 |

TABLE 3-continued

| | | | | | | | | |
|---|---|---|---|---|---|---|---|---|
| 11 | C | 1250 | 900 | 510 | 45 | 740 | 21 | 460 |
| 12 | C | 1250 | 900 | 510 | 45 | 870 | 20 | 460 |
| 13 | C | 1250 | 900 | 510 | 45 | 870 | 25 | 460 |
| 14 | D | 1250 | 900 | 550 | 50 | 880 | 15 | 480 |
| 15 | E | 1250 | 900 | 500 | 50 | 880 | 16 | 480 |
| 16 | F | 1250 | 900 | 550 | 50 | 880 | 20 | 480 |
| 17 | F | 1250 | 900 | 550 | 50 | 880 | 20 | 480 |
| 18 | F | 1250 | 900 | 550 | 50 | 880 | 20 | 480 |
| 19 | G | 1250 | 900 | 510 | 50 | 870 | 20 | 460 |
| 20 | G | 1250 | 900 | 510 | 50 | 870 | 20 | 340 |
| 21 | G | 1250 | 900 | 510 | 50 | 870 | 20 | 560 |
| 22 | G | 1250 | 900 | 510 | 50 | 880 | 8 | 460 |
| 23 | H | 1250 | 900 | 500 | 50 | 865 | 22 | 470 |
| 24 | I | 1250 | 900 | 500 | 50 | 865 | 18 | 470 |
| 25 | J | 1250 | 900 | 500 | 50 | 865 | 22 | 470 |
| 26 | K | 1250 | 900 | 500 | 50 | 865 | 20 | 470 |
| 27 | L | 1250 | 900 | 550 | 50 | 870 | 20 | 480 |
| 28 | L | 1250 | 900 | 550 | 50 | 870 | 20 | 480 |
| 29 | L | 1250 | 900 | 550 | 50 | 870 | 20 | 480 |
| 30 | M | 1250 | 900 | 510 | 45 | 870 | 21 | 460 |
| 31 | N | 1250 | 900 | 510 | 45 | 870 | 21 | 460 |
| 32 | O | 1250 | 900 | 500 | 45 | 870 | 20 | 480 |
| 33 | P | 1250 | 900 | 500 | 45 | 870 | 20 | 480 |
| 34 | Q | 1250 | 900 | 500 | 45 | 870 | 20 | 460 |
| 35 | R | 1250 | 900 | 550 | 50 | 870 | 20 | 480 |
| 36 | S | 1250 | 900 | 510 | 45 | 870 | 20 | 460 |
| 37 | T | 1250 | 900 | 550 | 50 | 880 | 20 | 480 |
| 38 | U | 1250 | 900 | 510 | 50 | 870 | 20 | 450 |
| 39 | V | 1250 | 900 | 510 | 50 | 870 | 20 | 450 |
| 40 | W | 1250 | 900 | 510 | 45 | 870 | 15 | 430 |
| 41 | X | 1250 | 900 | 510 | 45 | 870 | 15 | 430 |

| | | Second heat treatment | | | | | | |
|---|---|---|---|---|---|---|---|---|
| No. | Galvanizing treatment Type | Cooling stop temperature T5 [° C.] | Re-heating temperature T6 [° C.] | Average cooling rate v2 [° C./s] | Retension time $t_1$ in temperature range T1 [s] | Retension time $t_2$ in temperature range T2 [s] | $3t_1/t_2$ | Remarks |
| 1 | GA | 200 | 350 | 4.6 | 60 | 53 | 3.4 | Suitable steel |
| 2 | GA | 220 | 600 | 5.2 | 40 | 70 | 1.7 | Suitable steel |
| 3 | GA | 200 | 400 | 6.1 | 80 | 55 | 4.4 | Suitable steel |
| 4 | GA | 200 | 350 | 11.5 | 55 | 60 | 2.8 | Comparative steel |
| 5 | GA | 200 | 350 | 6.2 | 55 | 55 | 3.0 | Suitable steel |
| 6 | GA | 150 | 340 | 6.1 | 60 | 70 | 2.6 | Suitable steel |
| 7 | GA | 200 | 350 | 7.0 | 50 | 65 | 2.3 | Comparative steel |
| 8 | GA | 200 | 350 | 7.5 | 50 | 65 | 2.3 | Comparative steel |
| 9 | GA | 200 | 400 | 5.2 | 65 | 45 | 4.3 | Suitable steel |
| 10 | GA | 200 | 400 | 5.4 | 65 | 48 | 4.1 | Comparative steel |
| 11 | GA | 200 | 400 | 5.1 | 65 | 48 | 4.1 | Comparative steel |
| 12 | GA | 200 | 400 | 5.6 | 30 | 100 | 0.9 | Comparative steel |
| 13 | GA | 200 | 400 | 5.6 | 95 | 35 | 8.1 | Comparative steel |
| 14 | GA | 60 | 500 | 8.6 | 60 | 60 | 3.0 | Suitable steel |
| 15 | GA | 200 | 350 | 8.1 | 60 | 55 | 3.3 | Suitable steel |
| 16 | GA | 200 | 350 | 4.2 | 65 | 50 | 3.9 | Suitable steel |
| 17 | GA | 40 | 500 | 4.6 | 65 | 50 | 3.9 | Comparative steel |
| 18 | GA | 360 | 500 | 5.6 | 65 | 50 | 3.9 | Comparative steel |
| 19 | GA | 200 | 400 | 5.4 | 65 | 45 | 4.3 | Suitable steel |
| 20 | GA | 200 | 400 | 7.8 | 65 | 45 | 4.3 | Comparative steel |

TABLE 3-continued

| | | | | | | | | |
|---|---|---|---|---|---|---|---|---|
| 21 | GA | 200 | 500 | 8.2 | 65 | 45 | 4.3 | Comparative steel |
| 22 | GA | 200 | 400 | 5.9 | 65 | 45 | 4.3 | Comparative steel |
| 23 | GA | 200 | 350 | 6.2 | 55 | 55 | 3.0 | Comparative steel |
| 24 | GA | 200 | 350 | 11.5 | 55 | 55 | 3.0 | Comparative steel |
| 25 | GA | 200 | 350 | 6.8 | 55 | 55 | 3.0 | Comparative steel |
| 26 | GA | 200 | 350 | 8.1 | 55 | 55 | 3.0 | Comparative steel |
| 27 | GA | 210 | 400 | 7.5 | 60 | 50 | 3.6 | Suitable steel |
| 28 | GA | 210 | 250 | 7.6 | 60 | 50 | 3.6 | Comparative steel |
| 29 | GA | 210 | 550 | 7.2 | 60 | 50 | 3.6 | Comparative steel |
| 30 | GA | 200 | 400 | 9.5 | 65 | 40 | 4.9 | Comparative steel |
| 31 | GA | 200 | 400 | 7.5 | 65 | 40 | 4.9 | Comparative steel |
| 32 | GA | 200 | 350 | 6.3 | 60 | 50 | 3.6 | Suitable steel |
| 33 | GA | 200 | 400 | 6.4 | 80 | 60 | 4.0 | Suitable steel |
| 34 | GA | 200 | 350 | 7.8 | 60 | 55 | 3.3 | Suitable steel |
| 35 | GA | 210 | 400 | 7.5 | 60 | 50 | 3.6 | Suitable steel |
| 36 | GA | 200 | 400 | 6.8 | 70 | 50 | 4.2 | Suitable steel |
| 37 | GA | 200 | 350 | 8.5 | 60 | 55 | 3.3 | Suitable steel |
| 38 | GI | 200 | 400 | 9.2 | 70 | 50 | 4.2 | Suitable steel |
| 39 | GA | 200 | 400 | 7.6 | 70 | 50 | 4.2 | Suitable steel |
| 40 | GI | 200 | 350 | 6.5 | 80 | 40 | 6.0 | Suitable steel |
| 41 | GI | 200 | 350 | 5.8 | 80 | 40 | 6.0 | Suitable steel |

TABLE 4

| | Microstructure Area fraction [%] | | | | | | | | | |
|---|---|---|---|---|---|---|---|---|---|---|
| No. | Total of tempered martensite and bainite | Retained austenite | Retained austenite having aspect ratio of 5.5 or higher with respect to entire retained austenite | Fresh martensite having diameter of 2.0 μm or less | TS [MPa] | EL [%] | λ [%] | Amount of diffusible hydrogen in steel [mass ppm] | Fatigue test of spot welding portion | Remarks |
| 1 | 81 | 11 | 25 | 7 | 1490 | 12.0 | 40 | 0.25 | A | Suitable steel |
| 2 | 78 | 9 | 22 | 11 | 1520 | 11.2 | 35 | 0.32 | A | Suitable steel |
| 3 | 85 | 8 | 26 | 5 | 1420 | 11.8 | 38 | 0.31 | A | Suitable steel |
| 4 | 61 | 6 | 49 | 23 | 1320 | 9.5 | 16 | 0.45 | C | Comparative steel |
| 5 | 83 | 9 | 20 | 12 | 1505 | 10.3 | 38 | 0.21 | A | Suitable steel |
| 6 | 86 | 7 | 22 | 5 | 1530 | 10.1 | 42 | 0.18 | A | Suitable steel |
| 7 | 82 | 5 | 25 | 30 | 1510 | 9.1 | 30 | 0.42 | C | Comparative steel |
| 8 | 53 | 5 | 27 | 15 | 1300 | 10.1 | 21 | 0.41 | A | Comparative steel |
| 9 | 86 | 8 | 30 | 5 | 1380 | 12.4 | 28 | 0.08 | A | Suitable steel |
| 10 | 94 | 5 | 48 | 19 | 1450 | 10.0 | 20 | 0.75 | C | Comparative steel |
| 11 | 35 | 5 | 47 | 19 | 1160 | 12.1 | 22 | 0.41 | A | Comparative steel |

TABLE 4-continued

| No. | Microstructure Area fraction [%] Total of tempered martensite and bainite | Retained austenite | Retained austenite having aspect ratio of 5.5 or higher with respect to entire retained austenite | Fresh martensite having diameter of 2.0 μm or less | TS [MPa] | EL [%] | λ [%] | Amount of diffusible hydrogen in steel [mass ppm] | Fatigue test of spot welding portion | Remarks |
|---|---|---|---|---|---|---|---|---|---|---|
| 12 | 60 | 5 | 62 | 17 | 1450 | 8.4 | 21 | 0.41 | C | Comparative steel |
| 13 | 97 | 2 | 48 | 10 | 1410 | 7.5 | 20 | 0.28 | A | Comparative steel |
| 14 | 80 | 7 | 15 | 7 | 1330 | 12.5 | 28 | 0.07 | B | Suitable steel |
| 15 | 81 | 12 | 22 | 11 | 1510 | 12.1 | 26 | 0.12 | B | Suitable steel |
| 16 | 70 | 23 | 30 | 5 | 1590 | 24.5 | 25 | 0.12 | B | Suitable steel |
| 17 | 96 | 2 | 5 | 16 | 1520 | 4.2 | 22 | 0.18 | B | Comparative steel |
| 18 | 69 | 5 | 6 | 30 | 1500 | 6.5 | 14 | 0.46 | C | Comparative steel |
| 19 | 85 | 8 | 32 | 6 | 1385 | 12.2 | 35 | 0.35 | A | Suitable steel |
| 20 | 96 | 3 | 35 | 8 | 1350 | 6.2 | 22 | 0.42 | A | Comparative steel |
| 21 | 62 | 3 | 40 | 18 | 1420 | 6.5 | 23 | 0.45 | A | Comparative steel |
| 22 | 50 | 5 | 5 | 10 | 1310 | 7.5 | 22 | 0.47 | A | Comparative steel |
| 23 | 61 | 5 | 20 | 19 | 1300 | 10.1 | 20 | 0.45 | A | Comparative steel |
| 24 | 70 | 5 | 48 | 18 | 1530 | 10.2 | 21 | 0.41 | C | Comparative steel |
| 25 | 85 | 10 | 45 | 16 | 1680 | 12.1 | 23 | 0.43 | C | Comparative steel |
| 26 | 50 | 5 | 20 | 18 | 1230 | 11.2 | 22 | 0.36 | A | Comparative steel |
| 27 | 82 | 10 | 38 | 6 | 1590 | 15.6 | 42 | 0.06 | A | Suitable steel |
| 28 | 75 | 3 | 5 | 8 | 1650 | 4.5 | 22 | 0.44 | A | Comparative steel |
| 29 | 76 | 4 | 6 | 9 | 1610 | 5.2 | 25 | 0.46 | A | Comparative steel |
| 30 | 70 | 10 | 35 | 18 | 1500 | 10.1 | 25 | 0.35 | C | Comparative steel |
| 31 | 62 | 6 | 34 | 16 | 1310 | 10.2 | 20 | 0.38 | A | Comparative steel |
| 32 | 82 | 10 | 26 | 7 | 1495 | 12.5 | 42 | 0.21 | A | Suitable steel |
| 33 | 85 | 8 | 27 | 5 | 1420 | 11.9 | 45 | 0.25 | A | Suitable steel |
| 34 | 82 | 9 | 40 | 6 | 1520 | 10.2 | 38 | 0.32 | A | Suitable steel |
| 35 | 83 | 9 | 39 | 6 | 1590 | 15.2 | 35 | 0.29 | A | Suitable steel |
| 36 | 85 | 8 | 30 | 6 | 1380 | 12.7 | 35 | 0.15 | B | Suitable steel |
| 37 | 75 | 19 | 30 | 5 | 1580 | 23.6 | 25 | 0.16 | A | Suitable steel |
| 38 | 84 | 8 | 45 | 6 | 1420 | 14.2 | 28 | 0.06 | B | Suitable steel |
| 39 | 82 | 6 | 20 | 7 | 1375 | 10.3 | 35 | 0.21 | A | Suitable steel |
| 40 | 80 | 11 | 48 | 9 | 1460 | 13.2 | 28 | 0.11 | B | Suitable steel |
| 41 | 82 | 5 | 30 | 6 | 1360 | 11.5 | 38 | 0.13 | A | Suitable steel |

<Summary of Evaluation Results>

Tables 1 to 4 above show that the galvanized steel sheets of Nos. 1 to 3, 5, 6, 9, 14 to 16, 19, 27 and 32 to 41 all had the tensile strength of not less than 1,320 MPa, and also had excellent formability and fatigue strength of a spot welding portion.

In the galvanized steel sheets of Nos. 4, 7, 8, 10 to 13, 17, 18, 20 to 26, and 28 to 31, on the other hand, at least one of the tensile strength, the formability, or the fatigue strength of a spot welding portion was insufficient.

Furthermore, the galvanized steel sheets of Nos. 1 to 3, 5, 6, 9, 14 to 16, 19, 27, and 32 to 41 were subjected to forming processing or joining processing, and members were obtained therefrom.

The members thus obtained all had the tensile strength of not less than 1,320 MPa, and also had excellent formability and fatigue strength of a spot welding portion.

Test Example 2

<Production of Galvanized Steel Sheet>

A steel slab of a steel of reference symbol (see Tables 1 to 2 above) shown in Table 5 was subjected to hot rolling under the conditions shown Table 5 below, whereby a hot rolled steel sheet was obtained. Specifically, the steel slab was heated to 1, 250° C. and roughly rolled. Next, finish rolling was performed at the finish rolling termination temperature of 900° C., and the steel was coiled at the coiling temperature shown in Table 5 below.

The thus coiled hot rolled steel sheet was subjected to cold rolling at the rolling rate shown in Table 5 below, whereby a cold rolled steel sheet was obtained.

The obtained cold rolled steel sheets in some of the examples were subjected to electroplating treatment using an Fe-based plating bath to thereby form an Fe-based plating layer, prior to performing the first heat treatment described later.

For a case where the electroplating treatment was performed, "Done" was placed, while "-" was placed for a case where the electroplating treatment was not performed in Table 5 below. The coating weight of the formed Fe-based plating layer was shown in Table 6.

Before the electroplating treatment was performed, a surface of the cold rolled steel sheet was degreased using alkali.

As the Fe-based plating bath, a sulfuric acid bath (bath temperature: 50° C., pH: 2.0) containing 1.5 mol/L of $Fe^{2+}$ ions was used.

Taking the cold rolled steel sheet and an iridium oxide electrode as a cathode and an anode, respectively, electrolytic treatment was performed in the Fe-based plating bath with a current density of 45 A/dm$^2$. The coating weight of the Fe-based plating layer was regulated by adjusting the current application time.

The obtained cold rolled steel sheet (or cold rolled steel sheet having undergone electroplating treatment) was subjected to the first heat treatment, the galvanizing treatment, and the second heat treatment under the conditions shown in Table 5 below.

In every example, the cold rolled steel sheet was retained at the heating temperature T3 in an atmosphere having the dew point shown in Table 5 below for 100 seconds.

In addition, in every example, after the cold rolled steel sheet was cooled to the cooling stop temperature T5, the temperature thereof was immediately raised to the re-heating temperature T6 without being retained at the cooling stop temperature T5.

In the galvanizing treatment, both sides of the cold rolled steel sheet having undergone the first heat treatment were subjected to the hot-dip galvannealing treatment, whereby the hot-dip galvannealed steel sheet (GA) was obtained.

As the hot-dip galvannealing bath, a zinc bath (bath temperature: 470° C. containing Al in an amount of 0.14 mass % with the balance being Zn and inevitable impurities was used. The coating weight of the galvanizing layer was 45 g/m$^2$ per side. The alloying temperature was 530° C.

The composition of the galvanizing layer of GA contained Fe in an amount of 7 to 15 mass %, and Al in an amount of 0.1 to 1.0 mass %, with the balance being Fe and inevitable impurities.

Hereinafter, the galvanized steel sheet (hot-dip galvannealed steel sheet (GA)) having undergone the second heat treatment is also simply referred to as "galvanized steel sheet."

<Observation of Microstructure>

In the same manner as in [Test Example 1] above, the microstructure of the steel sheet in the obtained galvanized steel sheet was observed. The results are shown in Table 6 below.

<Measurement of Decarburized Layer Thickness>

The thickness of the decarburized layer in the obtained galvanized steel sheet was measured according to the foregoing method. The results are shown in Table 6 below.

<Evaluation>

The tensile test and the hole expanding test were conducted on the obtained galvanized steel sheet in the same manner as in [Test Example 1] above, and TS, EL and A were determined.

Moreover, the amount of diffusible hydrogen in steel of the steel sheet was determined in the same manner as in [Test Example 1] above. Here, when the galvanizing layer contained an Fe-based plating layer, an Fe-based plating layer in addition to the galvanizing layer was removed, and thereafter the amount of diffusible hydrogen in steel of the steel sheet was measured.

Furthermore, the fatigue testing was conducted in the same manner as in [Test Example 1] above to measure the fatigue strength of a spot welding portion.

The results are shown in Table 6 below.

<<Resistance to Resistance-weld Cracking at Spot Welding Portion>>

A specimen was cut out from the obtained galvanized steel sheet and evaluated for resistance to resistance-weld cracking at a spot welding portion according to the testing method described with reference to FIGS. 2 to 4.

A counter specimen was cut out from a testing hot-dip galvannealed steel sheet (sheet thickness t: 1.6 mm) having a tensile strength of 980 MPa level and a coating weight of the galvanizing layer of 50 g/m$^2$.

With the angle θ being 5 degrees, a sheet assembly composed of the specimen and the counter specimen was subjected to resistance welding under the conditions of pressure: 3.5 kN, holding time: 0.12 seconds, 0.18 seconds, or 0.24 seconds, and welding current and welding time with which a nugget diameter d of 5.9 mm would be achieved, whereby a welding portion was formed.

The cross section of the welding portion was observed, and the resistance to resistance-weld cracking at the welding portion was evaluated according to the following criteria.

When the result is A+, A, or B, the resistance to resistance-weld cracking at a welding portion was determined as excellent. The results are shown in Table 6 below.

A+: no cracks of 0.1 mm or longer was observed with holding time of 0.12 seconds A: a crack of 0.1 mm or longer was observed with holding time of 0.12 seconds, but no cracks of 0.1 mm or longer was observed with holding time of 0.18 seconds B: a crack of 0.1 mm or longer was observed with holding time of 0.18 seconds, but no cracks of 0.1 mm or longer was observed with holding time of 0.24 seconds C: a crack of 0.1 mm or longer was observed with holding time of 0.24 seconds

TABLE 5

| | | Hot rolling | | | | | First heat treatment | | | |
|---|---|---|---|---|---|---|---|---|---|---|
| No. | Steel reference symbol | Steel slab heating temperature [° C.] | Finish rolling termination temperature [° C.] | Coiling temperature [° C.] | Cold rolling Rolling rate [%] | Electro-plating treatment | Heating temperature T3 [° C.] | Dew point [° C.] | Average cooling rate v1 [° C./s] | Cooling stop temperature T4 [° C.] |
| 1 | A | 1250 | 900 | 500 | 45 | — | 870 | −32 | 20 | 480 |
| 42 | A | 1250 | 900 | 500 | 45 | — | 870 | 8 | 20 | 480 |
| 43 | A | 1250 | 900 | 500 | 45 | — | 870 | 13 | 20 | 480 |
| 44 | A | 1250 | 900 | 500 | 45 | Done | 870 | −26 | 20 | 480 |
| 45 | A | 1250 | 900 | 500 | 45 | Done | 870 | 7 | 20 | 480 |
| 15 | E | 1250 | 900 | 500 | 50 | — | 880 | −34 | 16 | 480 |
| 46 | E | 1250 | 900 | 500 | 50 | Done | 880 | 19 | 16 | 480 |

| | | Second heat treatment | | | | | | |
|---|---|---|---|---|---|---|---|---|
| No. | Galvanizing treatment Type | Cooling stop temperature T5 [° C.] | Reheating temperature T6 [° C.] | Average cooling rate v2 [° C./s] | Retaining time t1 in temperature range T1 [s] | Retaining time t2 in temperature range T2 [s] | $3t_1/t_2$ | Remarks |
| 1 | GA | 200 | 350 | 4.6 | 60 | 53 | 3.4 | Suitable steel |
| 42 | GA | 200 | 350 | 4.6 | 60 | 53 | 3.4 | Suitable steel |
| 43 | GA | 200 | 350 | 4.6 | 60 | 53 | 3.4 | Suitable steel |
| 44 | GA | 200 | 350 | 4.6 | 60 | 53 | 3.4 | Suitable steel |
| 45 | GA | 200 | 350 | 4.6 | 60 | 53 | 3.4 | Suitable steel |
| 15 | GA | 200 | 350 | 8.1 | 60 | 55 | 3.3 | Suitable steel |
| 46 | GA | 200 | 350 | 8.1 | 60 | 55 | 3.3 | Suitable steel |

TABLE 6

| | Microstructure Area fraction [%] | | | | | |
|---|---|---|---|---|---|---|
| No. | Total of tempered martensite and bainite | Retained austenite | Retained austenite having aspect ratio of 5.5 or higher with respect to entire retained austenite | Fresh martensite having diameter of 2.0 μm or less | Decarburized layer Thickness [μm] | Fe-based plating layer Coating weight [g/m$^2$] |
| 1 | 81 | 11 | 25 | 7 | — | — |
| 42 | 82 | 10 | 25 | 8 | 42 | — |
| 43 | 83 | 11 | 24 | 10 | 53 | — |
| 44 | 81 | 9 | 26 | 7 | 19 | 21.1 |
| 45 | 80 | 8 | 25 | 9 | 46 | 6.5 |
| 15 | 81 | 12 | 22 | 11 | — | — |
| 46 | 81 | 12 | 22 | 11 | 62 | 14.1 |

| No. | TS [MPa] | EL [%] | λ [%] | Amount of diffusible hydrogen in steel [mass ppm] | Fatigue test of spot welding portion | Resistance to resistance-weld cracking | Remarks |
|---|---|---|---|---|---|---|---|
| 1 | 1490 | 12.0 | 40 | 0.25 | A | B | Suitable steel |
| 42 | 1490 | 12.0 | 45 | 0.25 | A | A | Suitable steel |

TABLE 6-continued

| | | | | | | | |
|---|---|---|---|---|---|---|---|
| 43 | 1510 | 11.7 | 42 | 0.26 | A | A | Suitable steel |
| 44 | 1480 | 12.0 | 40 | 0.28 | A | A | Suitable steel |
| 45 | 1490 | 12.0 | 40 | 0.25 | A | A+ | Suitable steel |
| 15 | 1510 | 12.1 | 26 | 0.12 | B | C | Suitable steel |
| 46 | 1510 | 12.1 | 26 | 0.13 | B | A | Suitable steel |

<Summary of Evaluation Results>

Tables 5 to 6 above show that the galvanized steel sheets of Nos. 1, 15, and 42 to 46 all had the tensile strength of not less than 1,320 MPa, and also had excellent formability and fatigue strength of a spot welding portion.

The galvanized steel sheets of Nos. 1, 15, and 42 to 46 were further subjected to forming processing or joining processing to obtain members.

The members thus obtained all had the tensile strength of not less than 1, 320 MPa, and also had excellent formability and fatigue strength of a spot welding portion.

Next, Nos. 1 and 42 to 45 using the steel of reference symbol A were compared.

The steel sheets of Nos. 42 and 43 having the decarburized layer (but no Fe-based plating layer) exhibited excellent resistance to resistance-weld cracking, compared to that of No. 1 having no decarburized layer nor Fe-based plating layer.

In addition, the steel sheet of No. 45 having both the decarburized layer and the Fe-based plating layer exhibited more excellent resistance to resistance-weld cracking, compared to those of Nos. 42 and 43.

The steel sheet of No. 44 had both the decarburized layer and the Fe-based plating layer, but the resistance to resistance-weld cracking was about the same as that of Nos. 42 and 43 presumably because the thickness of the decarburized layer was small.

Next, Nos. 15 and 46 using the steel of reference symbol E were compared.

The steel sheet of No. 46 having both the decarburized layer and the Fe-based plating layer exhibited excellent resistance to resistance-weld cracking, compared to that of No. 15 having no decarburized layer nor Fe-based plating layer.

The members obtained by subjecting the galvanized steel sheets of Nos. 1 and 42 to 46 to forming processing or joining processing exhibited excellent resistance to resistance-weld cracking.

The invention claimed is:

1. A high strength galvanized steel sheet comprising a steel sheet and a galvanizing layer and having a tensile strength of not less than 1,320 MPa, wherein the steel sheet has a chemical composition containing, by mass, C: 0.150 to 0.450%, Si: 0.80 to 3.00%

Mn: 2.00 to 4.00%,

P: not more than 0.100%,

S: not more than 0.0200%,

Al: not more than 0.100%,

O: not more than 0.0100%, and

N: not more than 0.0100%, with a balance of Fe and inevitable impurities, and a microstructure, an amount of diffusible hydrogen in the steel sheet is not more than 0.60 mass ppm, and in the microstructure, a total area fraction of tempered martensite and bainite is 60 to 95%, an area fraction of retained austenite is 5 to 30%, an area fraction of the retained austenite having an aspect ratio of 5.5 or higher with respect to a whole of the retained austenite is not more than 50%, and an area fraction of fresh martensite having a diameter of 2.0 μm or less is not more than 20%.

2. The high strength galvanized steel sheet according to claim 1, wherein the chemical composition further contains at least one element selected from the group consisting of, by mass, B: not more than 0.0050%, Ti: not more than 0.200%, Nb: not more than 0.200%, V: not more than 0.500%, W: not more than 0.500%, Mo: not more than 1.000%, Cr: not more than 1.000%, Sb: not more than 0.200%, Sn: not more than 0.200%, Zr: not more than 0.1000%, Cu: not more than 1.000%, Ni: not more than 1.000%, Ca: not more than 0.0050%, Mg: not more than 0.0050%, REM: not more than 0.0050%, Co: not more than 0.30%, Ta: not more than 0.10%, As: not more than 0.100%, Pb: not more than 0.100%, Zn: not more than 0.100%, Bi: not more than 0.100%, and Hf: not more than 0.10%.

3. The high strength galvanized steel sheet according to claim 1, satisfying at least one of the following (i) to (v):

(i) the steel sheet includes a decarburized layer, (il) the high strength galvanized steel sheet includes a metal plating layer on at least one side of the steel sheet and between the steel sheet and the galvanizing layer, (iii) the high strength galvanized steel sheet includes a metal plating layer on at least one side of the steel sheet and between the steel sheet and the galvanizing layer, where the metal plating layer has a chemical composition comprising Fe and inevitable impurities, (iv) the high strength galvanized steel sheet includes a metal plating layer on at least one side of the steel sheet and between the steel sheet and the galvanizing layer, where the metal plating layer has a chemical composition comprising Fe and inevitable impurities and the chemical composition of the metal plating layer further contains at least one element selected from the group consisting of B, C, P, N, O, Ni, Mn, Mo, Zn, W, Pb, Sn, Cr, V, and Co in an amount of not more than 10 mass % in total, and (v) the high strength galvanized steel sheet is a hot-dip galvanized steel sheet or a hot-dip galvannealed steel sheet.

4. The high strength galvanized steel sheet according to claim 2, satisfying at least one of the following (i) to (v):

(i) the steel sheet includes a decarburized layer, (ii) the high strength galvanized steel sheet includes a metal plating layer on at least one side of the steel sheet and between the steel sheet and the galvanizing layer, (iii) the high strength galvanized steel sheet includes a metal plating layer on at least one side of the steel sheet and between the steel sheet and the galvanizing layer, where the metal plating layer has a chemical composition comprising Fe and inevitable impurities, (iv) the high strength galvanized steel sheet includes a metal plating layer on at least one side of the steel sheet and between the steel sheet and the galvanizing layer, where the metal plating layer has a chemical composition comprising Fe and inevitable impurities and the chemical composition of the metal plating layer further contains at least one element selected from the group consisting of B, C, P, N, O, Ni, Mn, Mo, Zn, W, Pb, Sn, Cr, V, and Co in an amount of not more than 10 mass % in total, and (v) the high strength galvanized steel sheet is a hot-dip galvanized steel sheet or a hot-dip galvannealed steel sheet.

5. A member that is obtained using the high strength galvanized steel sheet according to claim 1.

6. A member that is obtained using the high strength galvanized steel sheet according to claim 2.

7. A member that is obtained using the high strength galvanized steel sheet according to claim 3.

8. A member that is obtained using the high strength galvanized steel sheet according to claim 4.

9. A method for producing the high strength galvanized steel sheet according to claim 1, the method comprising:

hot rolling a steel slab having the chemical composition according to claim 1, and coiling a hot rolled steel sheet thus obtained at coiling temperature of 350 to 700° C., cold rolling the hot rolled steel sheet thus coiled to obtain a cold rolled steel sheet, and subjecting the cold rolled steel sheet to first heat treatment, galvanizing treatment, and second heat treatment in this order, wherein in the first heat treatment, the cold rolled steel sheet is heated at heating temperature T3 of 750 to 950° C., and cooled from the heating temperature T3 to cooling stop temperature T4 of 350 to 550° C. while an average cooling rate v1 from the heating temperature T3 to 550° C. is not lower than 10° C./s, in the second heat treatment, the cold rolled steel sheet is cooled to cooling stop temperature T5 of 50 to 350° C. and thereafter re-heated to re-heating temperature T6 of higher than the cooling stop temperature T5 and 300 to 500° C., followed by cooling to (Ms point-200)° C. to 50° C. at an average cooling rate v2 satisfying Formula (1) below, and in the first heat treatment, the galvanizing treatment, and the second heat treatment, retaining time $t_1$ in a temperature range T1 of 300° C. or higher and lower than 450° C. and retaining time $t_2$ in a temperature range T2 of 450° C. or higher and 600° C. or lower satisfy Formula (2) below, $$v2 \leq 3.8\ [C] + 2.4\ [Mn] + 1.2\ [Si] \quad (1)$$

$$1.1 \leq 3t_1/t_2 \leq 6.5 \quad (2)$$

where [C], [Mn], and [Si] in the Formula (1) respectively represent C content, Mn content, and Si content in the chemical composition, the content being in a unit of mass %.

10. A method for producing the high strength galvanized steel sheet according to claim 2, the method comprising:

hot rolling a steel slab having the chemical composition according to claim 2, and coiling a hot rolled steel sheet thus obtained at coiling temperature of 350 to 700° C., cold rolling the hot rolled steel sheet thus coiled to obtain a cold rolled steel sheet, and subjecting the cold rolled steel sheet to first heat treatment, galvanizing treatment, and second heat treatment in this order, wherein in the first heat treatment, the cold rolled steel sheet is heated at heating temperature T3 of 750 to 950° C., and cooled from the heating temperature T3 to cooling stop temperature T4 of 350 to 550° C. while an average cooling rate v1 from the heating temperature T3 to 550° C. is not lower than 10° C./s, in the second heat treatment, the cold rolled steel sheet is cooled to cooling stop temperature T5 of 50 to 350° C. and thereafter re-heated to re-heating temperature T6 of higher than the cooling stop temperature T5 and 300 to 500° C., followed by cooling to (Ms point-200° C.) to 50° C. at an average cooling rate v2 satisfying Formula (1) below, and in the first heat treatment, the galvanizing treatment, and the second heat treatment, retaining time $t_1$ in a temperature range T1 of 300° C. or higher and lower than 450° C. and retaining time $t_2$ in a temperature range T2 of 450° C. or higher and 600° C. or lower satisfy Formula (2) below, $$v2 \leq 3.8\ [C] + 2.4\ [Mn] + 1.2\ [Si] \quad (1)$$

$$1.1 \leq 3t_1/t_2 \leq 6.5 \quad (2)$$

where [C], [Mn], and [Si] in the Formula (1) respectively represent C content, Mn content, and Si content in the chemical composition, the content being in a unit of mass %.

11. The method according to claim 9 for producing the high strength galvanized steel sheet, wherein in the first heat treatment, the cold rolled steel sheet is heated at the heating temperature T3 in an atmosphere having a dew point of higher than −30° C. to form a decarburized layer at an uppermost layer of the cold rolled steel sheet.

12. The method according to claim 10 for producing the high strength galvanized steel sheet, wherein in the first heat treatment, the cold rolled steel sheet is heated at the heating temperature T3 in an atmosphere having a dew point of higher than −30° C. to form a decarburized layer at an uppermost layer of the cold rolled steel sheet.

13. The method according to claim 9 for producing the high strength galvanized steel sheet, satisfying at least one of the following (I) to (IV):

(I) before the first heat treatment, the cold rolled steel sheet is subjected to metal plating treatment to form a metal plating layer on at least one side of the cold rolled steel sheet, (II) before the first heat treatment, the cold rolled steel sheet is subjected to metal plating treatment to form a metal plating layer on at least one side of the cold rolled steel sheet, where the metal plating layer has a chemical composition comprising Fe and inevitable impurities, (III) before the first heat treatment, the cold rolled steel sheet is subjected to metal plating treatment to form a metal plating layer on at least one side of the cold rolled steel sheet, where the metal plating layer has a chemical composition comprising Fe and inevitable impurities and the chemical composition of the metal plating layer further contains at least one element selected from the group consisting of B, C, P, N, O, Ni, Mn, Mo, Zn, W, Pb, Sn, Cr, V, and Co in an amount of not more than 10 mass % in total, (IV) the galvanizing treatment is hot-dip galvanizing treatment or hot-dip galvannealing treatment.

14. The method according to claim 10 for producing the high strength galvanized steel sheet, satisfying at least one of the following (I) to (IV):

(I) before the first heat treatment, the cold rolled steel sheet is subjected to metal plating treatment to form a metal plating layer on at least one side of the cold rolled steel sheet, (II) before the first heat treatment, the cold rolled steel sheet is subjected to metal plating treatment to form a metal plating layer on at least one side of the cold rolled steel sheet, where the metal plating layer has a chemical composition comprising Fe and inevitable impurities, (III) before the first heat treatment, the cold rolled steel sheet is subjected to metal plating treatment to form a metal plating layer on at least one side of the cold rolled steel sheet, where the metal plating layer has a chemical composition comprising Fe and inevitable impurities and the chemical composition of the metal plating layer further contains at least one element selected from the group consisting of B, C, P, N, O, Ni, Mn, Mo, Zn, W, Pb, Sn, Cr, V, and Co in an amount of not more than 10 mass % in total, (IV) the galvanizing treatment is hot-dip galvanizing treatment or hot-dip galvannealing treatment.

15. The method according to claim 11 for producing the high strength galvanized steel sheet, satisfying at least one of the following (I) to (IV):

(I) before the first heat treatment, the cold rolled steel sheet is subjected to metal plating treatment to form a metal plating layer on at least one side of the cold rolled steel sheet, (II) before the first heat treatment, the cold rolled steel sheet is subjected to metal plating treatment to form a metal plating layer on at least one side of the cold rolled steel sheet, where the metal plating layer has a chemical composition comprising Fe and inevitable impurities, (III) before the first heat treatment, the cold rolled steel sheet is subjected to metal plating treatment to form a metal plating layer on at least one side of the cold rolled steel sheet, where the metal plating layer has a chemical composition comprising Fe and inevitable impurities and the chemical composition of the metal plating layer further contains at least one element selected from the group consisting of B, C, P, N, O, Ni, Mn, Mo, Zn, W, Pb, Sn, Cr, V, and Co in an amount of not more than 10 mass % in total, (IV) the galvanizing treatment is hot-dip galvanizing treatment or hot-dip galvannealing treatment.

16. The method according to claim 12 for producing the high strength galvanized steel sheet, satisfying at least one of the following (I) to (IV):

(I) before the first heat treatment, the cold rolled steel sheet is subjected to metal plating treatment to form a metal plating layer on at least one side of the cold rolled steel sheet, (II) before the first heat treatment, the cold rolled steel sheet is subjected to metal plating treatment to form a metal plating layer on at least one side of the cold rolled steel sheet, where the metal plating layer has a chemical composition comprising Fe and inevitable impurities, (III) before the first heat treatment, the cold rolled steel sheet is subjected to metal plating treatment to form a metal plating layer on at least one side of the cold rolled steel sheet, where the metal plating layer has a chemical composition comprising Fe and inevitable impurities and the chemical composition of the metal plating layer further contains at least one element selected from the group consisting of B, C, P, N, O, Ni, Mn, Mo, Zn, W, Pb, Sn, Cr, V, and Co in an amount of not more than 10 mass % in total, (IV) the galvanizing treatment is hot-dip galvanizing treatment or hot-dip galvannealing treatment.

17. A method for producing a member, the method comprising subjecting the high strength galvanized steel sheet according to claim 1 to at least one of forming processing or joining processing to obtain the member.

18. A method for producing a member, the method comprising subjecting the high strength galvanized steel sheet according to claim 2 to at least one of forming processing or joining processing to obtain the member.

19. A method for producing a member, the method comprising subjecting the high strength galvanized steel sheet according to claim 3 to at least one of forming processing or joining processing to obtain the member.

20. A method for producing a member, the method comprising subjecting the high strength galvanized steel sheet according to claim 4 to at least one of forming processing or joining processing to obtain the member.

* * * * *